US012446740B2

(12) United States Patent
Perry et al.

(10) Patent No.: US 12,446,740 B2
(45) **Date of Patent: *Oct. 21, 2025**

(54) SURFACE CLEANING APPARATUS

(71) Applicant: BISSELL INC., Grand Rapids, MI (US)

(72) Inventors: Joseph P. Perry, Comstock Park, MI (US); Tyler Newkirk, Grand Rapids, MI (US)

(73) Assignee: BISSELL Inc., Grand Rapids, MI (US)

( * ) Notice: Subject to any disclaimer, the term of this patent is extended or adjusted under 35 U.S.C. 154(b) by 421 days.

This patent is subject to a terminal disclaimer.

(21) Appl. No.: 17/824,492

(22) Filed: May 25, 2022

(65) Prior Publication Data

US 2022/0378258 A1 Dec. 1, 2022

Related U.S. Application Data

(63) Continuation-in-part of application No. 17/330,139, filed on May 25, 2021, now Pat. No. 11,659,968.

(51) Int. Cl.

| | |
|---|---|
| ***A47L 5/24*** | (2006.01) |
| ***A47L 7/00*** | (2006.01) |
| ***A47L 9/32*** | (2006.01) |

(52) U.S. Cl.

CPC ..... *A47L 5/24* (2013.01); *A47L 7/009* (2013.01); *A47L 9/322* (2013.01)

(58) Field of Classification Search

CPC ..... A47L 5/24; A47L 5/26; A47L 5/28; A47L 5/32; A47L 7/009; A47L 9/322; A47L 9/0009; A47L 9/009; A47L 9/32; A47L 9/325; A47L 9/0054

USPC ..... 15/354

See application file for complete search history.

(56) References Cited

U.S. PATENT DOCUMENTS

| | | | | |
|---|---|---|---|---|
| 1,733,536 | A * | 10/1929 | Guitschula | B60B 33/021 188/74 |
| 3,493,085 | A * | 2/1970 | Libhart | B60B 33/0078 188/74 |
| 4,513,469 | A | 4/1985 | Godfrey et al. | |
| 11,659,968 | B2 * | 5/2023 | Perry | A47L 9/009 15/354 |

(Continued)

FOREIGN PATENT DOCUMENTS

| | | | |
|---|---|---|---|
| CN | 108309149 | A | 7/2018 |
| JP | 2005137553 | A | 6/2005 |

(Continued)

OTHER PUBLICATIONS

European Patent Office, Extended European Search Report re Corresponding Application No. 22173717.4-1016 / 4094656, Nov. 10, 2022, 7 pages, Munich, Germany.

*Primary Examiner* — David S Posigian
*Assistant Examiner* — Michael A Gump
(74) *Attorney, Agent, or Firm* — McGarry Bair PC

(57) ABSTRACT

A surface cleaning apparatus such as a vacuum cleaner includes a suction source, a recovery container, and a base assembly with at least one agitator within an agitator chamber. The recovery container can be coupled to a separator assembly configured to remove dirt and debris from working fluid through the vacuum cleaner. In addition, a brake assembly can be provided on the base assembly and be configured to contact at least one wheel of the base assembly.

19 Claims, 17 Drawing Sheets

(56) References Cited

U.S. PATENT DOCUMENTS

| | | | | |
|---|---|---|---|---|
| 2003/0163888 | A1* | 9/2003 | Joo | A47L 9/0494 15/388 |
| 2009/0276977 | A1* | 11/2009 | Liao | B60B 33/0049 16/35 R |
| 2016/0174785 | A1* | 6/2016 | Conrad | A47L 9/1683 15/329 |
| 2017/0303754 | A1* | 10/2017 | Conrad | A47L 9/2873 |
| 2021/0378469 | A1* | 12/2021 | Valentini | A47L 9/24 |
| 2023/0190063 | A1* | 6/2023 | Knapp | A47L 9/0018 15/339 |

FOREIGN PATENT DOCUMENTS

| | | | |
|---|---|---|---|
| JP | 2017000196 | A | 1/2017 |
| JP | 2017159023 | A | 9/2017 |
| WO | 2017186280 | A1 | 11/2017 |
| WO | 2020192334 | A1 | 10/2020 |

* cited by examiner

SURFACE CLEANING APPARATUS

CROSS REFERENCE TO RELATED APPLICATIONS

This application is a continuation-in-part of U.S. patent application Ser. No. 17/330,139, filed May 25, 2021, now U.S. Pat. No. 11,659,968 which is incorporated herein by reference in its entirety.

BACKGROUND

Surface cleaning apparatuses such as vacuum cleaners are well-known devices for removing dirt and debris from a variety of surfaces such as carpets, hard floors, or other fabric surfaces such as upholstery. Such surface cleaning apparatuses typically include a recovery system including a recovery container, a nozzle adjacent the surface to be cleaned and in fluid communication with the recovery container through a conduit, and a source of suction in fluid communication with the conduit to draw debris-laden air from the surface to be cleaned and through the nozzle and the conduit to the recovery container.

BRIEF DESCRIPTION

In one aspect, the disclosure relates to a surface cleaning apparatus, comprising a base assembly including a suction nozzle and at least one wheel, a hand-held portion having a hand grip, a recovery container, and a suction source in fluid communication with the suction nozzle and the recovery container and configured for generating a working airstream, a wand operably coupled between the base assembly and the hand-held portion and defining at least a portion of a working air path extending from the suction nozzle to an air outlet in the hand-held portion and including the suction source, and a brake assembly pivotally mounted to the base assembly and moveable between a first locked position wherein at least a portion of the brake assembly contacts the at least one wheel and is configured to prevent rotation of the at least one wheel and a second unlocked position.

DETAILED DESCRIPTION

The disclosure relates to a surface cleaning apparatus such as a hand-held surface cleaner. Such hand-held cleaners can be in the form of a stick vacuum or wand vacuum. The surface cleaning apparatus can also include a base assembly including an agitator chamber. It will be understood that a variety of surface cleaning apparatus exist including those which are top heavy and additionally or alternatively include wheeled bases or bases including rotating portions. In either scenario, when an upper portion of the surface cleaning is leaned against a wall or other object, a lower portion may tend to move from the placed location. In certain circumstances this can cause the surface cleaning apparatus to tilt, fall, or otherwise cause dissatisfaction to a user.

A brake assembly can be provided on the base assembly and be configured to be moveable between at least a first position and a second position. When the brake assembly is in the first position, at least a portion of the brake assembly can restrain movement of the base of the surface cleaning apparatus. In one non-limiting example, the brake assembly can contact and restrain a set of wheels of the base assembly to prevent them from rotating.

Figure 1:
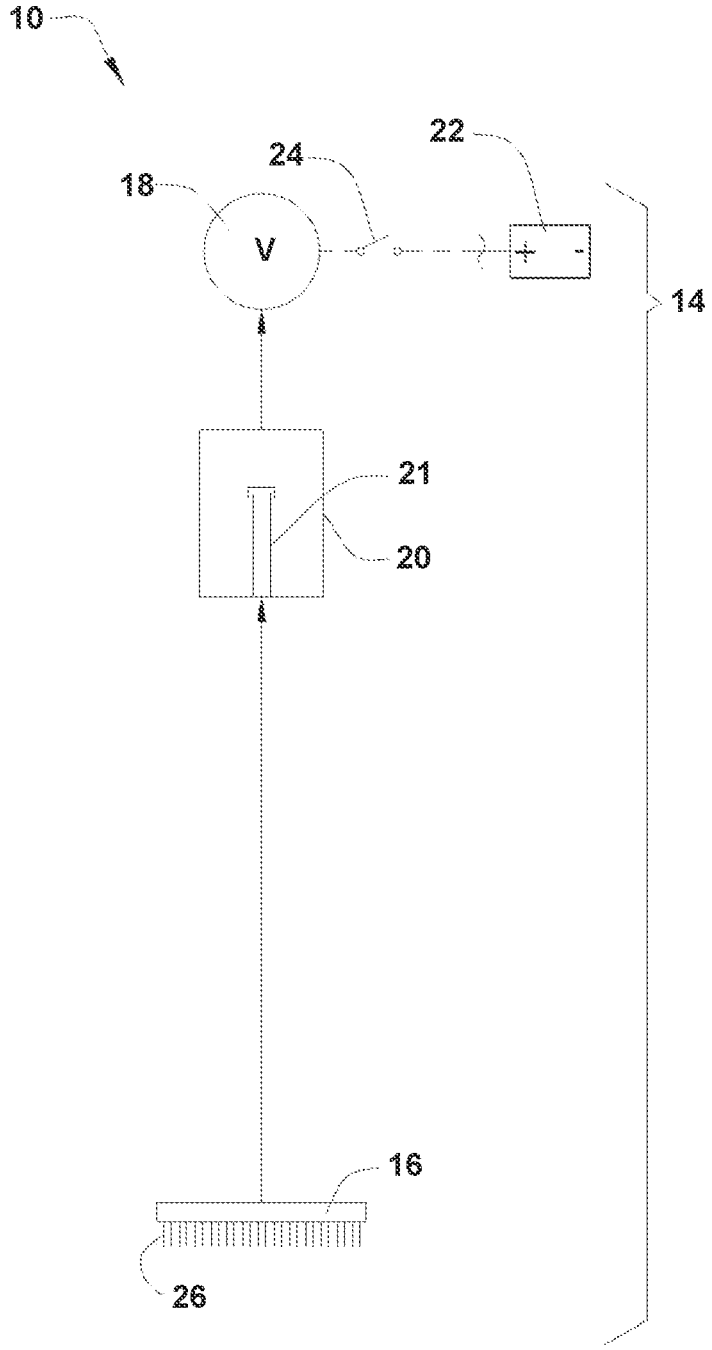
FIG. 1 is a schematic view of a surface cleaning apparatus according to various aspects described herein.

FIG. 1 is a schematic view of various functional systems of a surface cleaning apparatus in the form of an exemplary vacuum cleaner 10. The functional systems of the exemplary vacuum cleaner 10 can be arranged into any desired configuration including as a portable cleaner adapted to be hand carried by a user for cleaning relatively small areas. The vacuum cleaner 10 can be adapted to include a hose or other conduit, which can form a portion of the working air path between a nozzle and the suction source.

The vacuum cleaner 10 can include a recovery system 14 for removing debris from the surface to be cleaned and storing the debris. The recovery system 14 can include a suction inlet or suction nozzle 16, a suction source 18 in fluid communication with the suction nozzle 16 for generating a working air stream, and a recovery container 20 for separating and collecting debris from the working airstream for later disposal.

The suction nozzle 16 can be provided on a base or cleaning head adapted to move over the surface to be cleaned. At least one agitator 26 can be provided adjacent to the suction nozzle 16 for agitating the surface to be cleaned so that the debris can be more easily ingested into the suction nozzle 16. Some examples of agitators 26 include, but are not limited to, a horizontally-rotating brushroll, dual horizontally-rotating brushrolls, one or more vertically-rotating brushrolls, or a stationary brush. The at least one agitator 26 can also be configured to cling to or otherwise retain dirt or debris removed from the surface to be cleaned, such as a disposable cleaning pad, wherein such retained dirt or debris is not ingested into the suction nozzle 16.

The suction source 18 can be any suitable suction source and is provided in fluid communication with the recovery container 20. The suction source 18 can be electrically coupled to a power source 22, such as a battery or by a power cord plugged into a household electrical outlet. A suction power switch 24 between the suction source 18 and the power source 22 can be selectively closed by the user, thereby activating the suction source 18.

A separator 21 can be formed in a portion of the recovery container 20 for separating entrained debris from the working airstream.

The vacuum cleaner 10 shown in FIG. 1 can be used to effectively remove debris from the surface to be cleaned in accordance with the following method. The sequence of steps discussed is for illustrative purposes only and is not meant to limit the method in any way as it is understood that the steps may proceed in a different logical order, additional or intervening steps may be included, or described steps may be divided into multiple steps.

In operation, the vacuum cleaner 10 is prepared for use by coupling the vacuum cleaner 10 to the power source 22. During operation of the recovery system 14, the vacuum cleaner 10 draws in debris-laden working air through the suction nozzle 16 and into the downstream recovery container 20 where the debris is substantially separated from the working air and deposited in the recovery container. The airstream then passes through the suction source 18 prior to being exhausted from the vacuum cleaner 10. The recovery container 20 can be periodically emptied of collected fluid and debris.

While not illustrated it will be understood that the surface cleaning apparatus including the vacuum cleaner 10 can include a fluid delivery system for storing cleaning fluid and delivering the cleaning fluid to the surface to be cleaned. The fluid delivery system can include a fluid supply container for storing cleaning fluid, as well as at least one fluid distributor fluidly coupled to the fluid supply container.

Figure 2:
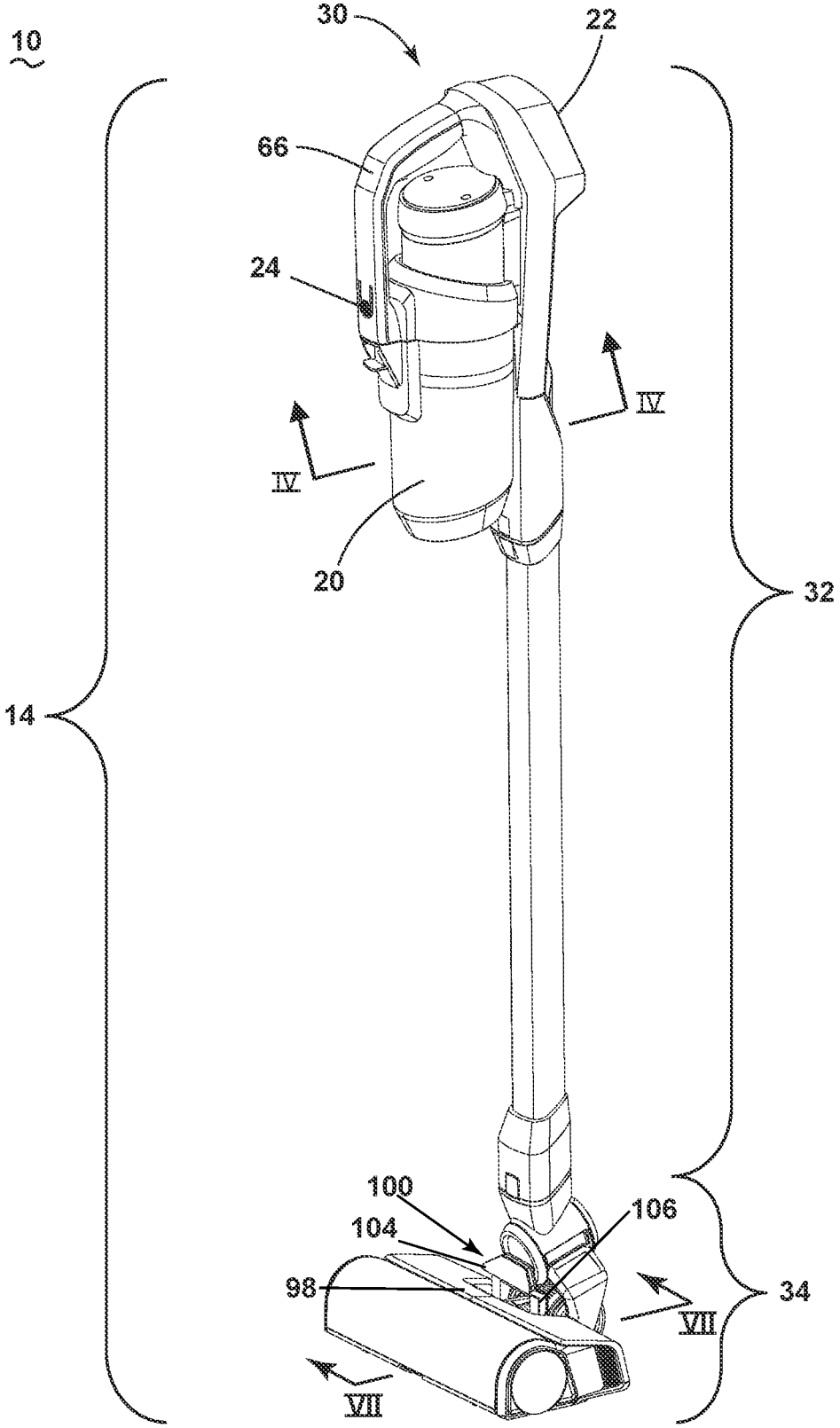
FIG. 2 is a perspective view of the surface cleaning apparatus of FIG. 1 in the form of a hand-held vacuum cleaner including a base assembly and an upright assembly according to various aspects described herein.

FIG. 2 is a perspective view illustrating a vacuum cleaner 10 according to various aspects described herein. For purposes of description related to the figures, the terms "upper," "lower," "right," "left," "rear," "front," "vertical," "horizontal," "inner," "outer," and derivatives thereof shall be described from the perspective of a user behind the vacuum cleaner 10, which defines the rear of the vacuum cleaner 10. However, it is to be understood that the disclosure may assume various alternative orientations, except where expressly specified to the contrary.

In the illustrated example, the vacuum cleaner 10 can include a housing 30 with an upright assembly 32 and a base assembly 34. The upright assembly 32 can be operably coupled to the base assembly 34 for directing the base assembly 34 across the surface to be cleaned. A joint or other pivoting mechanism can be utilized to pivotally connect the upright assembly 32 to the base assembly 34. It is contemplated that the vacuum cleaner 10 can include any or all of the various systems and components described in FIG. 1, including a recovery system 14 for separating and storing dirt or debris from the surface to be cleaned. The various systems and components schematically described for FIG. 1 can be supported by either the base assembly 34 or the upright assembly 32 of the vacuum cleaner 10 or both in combination.

Figure 3:
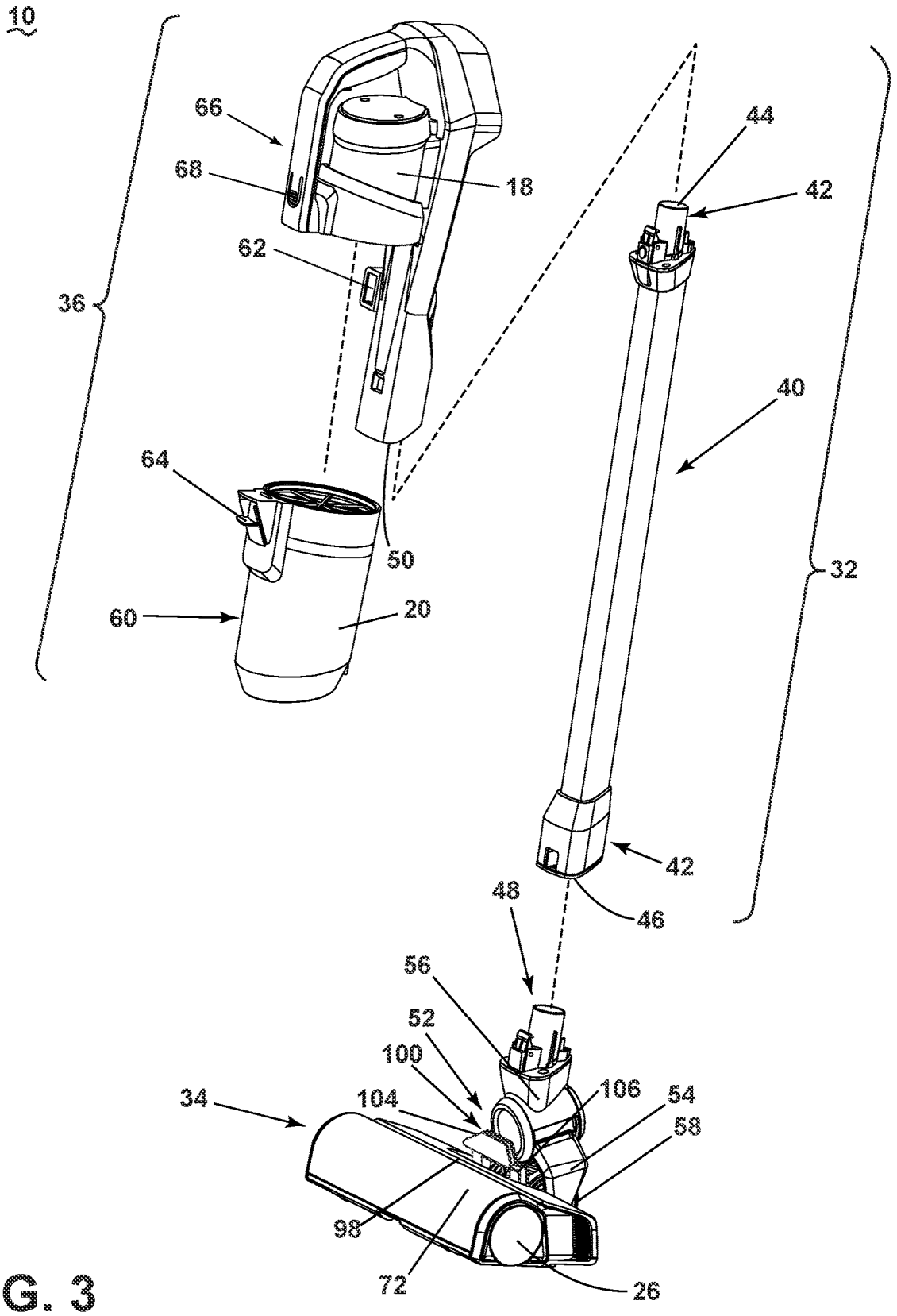
FIG. 3 is a partially-exploded view of the vacuum cleaner of FIG. 2, further including a brake assembly.

FIG. 3 illustrates a partially-exploded view of the vacuum cleaner 10 of FIG. 2. The upright assembly 32 includes a hand-held portion 36 supporting components of the recovery system 14, including, but not limited to, the suction source 18 and the recovery container 20. By way of non-limiting example, the suction source 18 can include a motor/fan assembly.

The hand-held portion 36 can be coupled to a wand 40 having at least one wand connector 42. In the illustrated example, both a first end 44 of the wand 40 and a second end 46 of the wand 40 include a wand connector 42. The wand connector 42 at the second end 46 of the wand 40 can be coupled to the base assembly 34 via a wand receiver 48. The wand connector 42 at the first end 44 of the wand 40 can couple to a second wand receiver 50 within the hand-held portion 36. It is contemplated that the wand connectors 42 can be the same type of connector or can vary in any suitable manner with respect to function, structure, design, profile, etc. Any suitable type of connector mechanism can be utilized, such as a quick connect mechanism or a tubing coupler in non-limiting examples.

A pivotal connection between the upright assembly 32 and the base assembly 34 can be provided by at least one pivoting mechanism. In the illustrated example, the pivoting mechanism can include a multi-axis swivel joint assembly 52 configured to pivot the upright assembly 32 from front-to-back and side-to-side with respect to the base assembly 34. However, this need not be the case and the pivoting mechanism can move in any suitable manner including that the upright assembly 32 may pivot about one single axis with respect to the base assembly 34. A lower portion 54 of the swivel joint assembly 52 is located between the wand 40 and the base assembly 34. The lower portion 54 of the swivel joint assembly 52 provides for pivotal forward and backward rotation between the wand 40 and the base assembly 34. An upper portion 56 of the swivel joint assembly 52 is also located between the wand 40 and the base assembly 34 and provides for lateral or side-to-side rotation between the wand 40 and base assembly 34. By way of non-limiting example, the lower portion 54 of the swivel joint assembly 52 is coupled between the base assembly 34 and the upper portion 56 of the swivel joint assembly 52. The upper portion 56 of the swivel joint assembly 52 is coupled to the wand receiver 48 at the second end 46 of the wand 40. Wheels 58 can be coupled to the lower portion 54 of the swivel joint assembly 52 or directly to the base assembly 34, and are adapted to move the base assembly 34 across the surface to be cleaned.

A brake assembly 100 can be provided with the base assembly 34. The brake assembly 100 can be located on an upper portion of the base assembly 34. By way of non-limiting example, the brake assembly 100 can be defined by a body 102 with at least a portion of the body extending into the base assembly 34 and another portion extending beyond an upper surface 98 of the base assembly 34. As a non-limiting example, the body 102 can include an upper portion or a handle 104 and at least one lower portion or at least one leg 106. The handle 104 can extend beyond the upper surface 98 of the base assembly 34 such that the handle 104 is accessible to a user. The at least one leg 106 can extend at least partially into the base assembly 34 adjacent the wheels 58, such that the at least one leg confronts, contacts, or is adjacent to at least one of the multiple wheels 58. In the illustrated example, the brake assembly 100 is near the pivotal connection between the upright assembly 32 and the base assembly 34.

The hand-held portion 36 can also include the recovery container 20, illustrated herein as a dirt separation and collection module 60 fluidly coupled to the suction source 18 via an air outlet port 62. The dirt separation and collection module 60 can be removable from the hand-held portion 36 by a release latch 64 as shown so that it can be emptied of debris. Additional details of the dirt separation and collection module and the cleaning apparatus are described in PCT Application No. PCT/US19/39424, filed Jun. 27, 2019, which is incorporated herein by reference in its entirety.

An upper end of the hand-held portion 36 can further include a hand grip 66 for maneuvering the vacuum cleaner 10 over a surface to be cleaned and for using the vacuum cleaner 10 in hand-held mode. At least one control mechanism 68 is provided on the hand grip 66 and coupled to the power source 22 (FIG. 1) for selective operation of components of the vacuum cleaner 10. In the contemplated example, the at least one control mechanism 68 is an electronic control that can form the suction power switch 24.

The agitator 26 of the illustrated aspect includes a brushroll 70 (FIG. 4) configured to rotate about a horizontal axis and operatively coupled to a drive shaft of a drive motor via a transmission, which can include one or more belts, gears, shafts, pulleys, or combinations thereof. An example of which will be explained in more detail below. An agitator housing 72 is provided around the suction nozzle 16 and defines an agitator chamber 74 (FIG. 4) for the brushroll 70 (FIG. 4).

Figure 4:
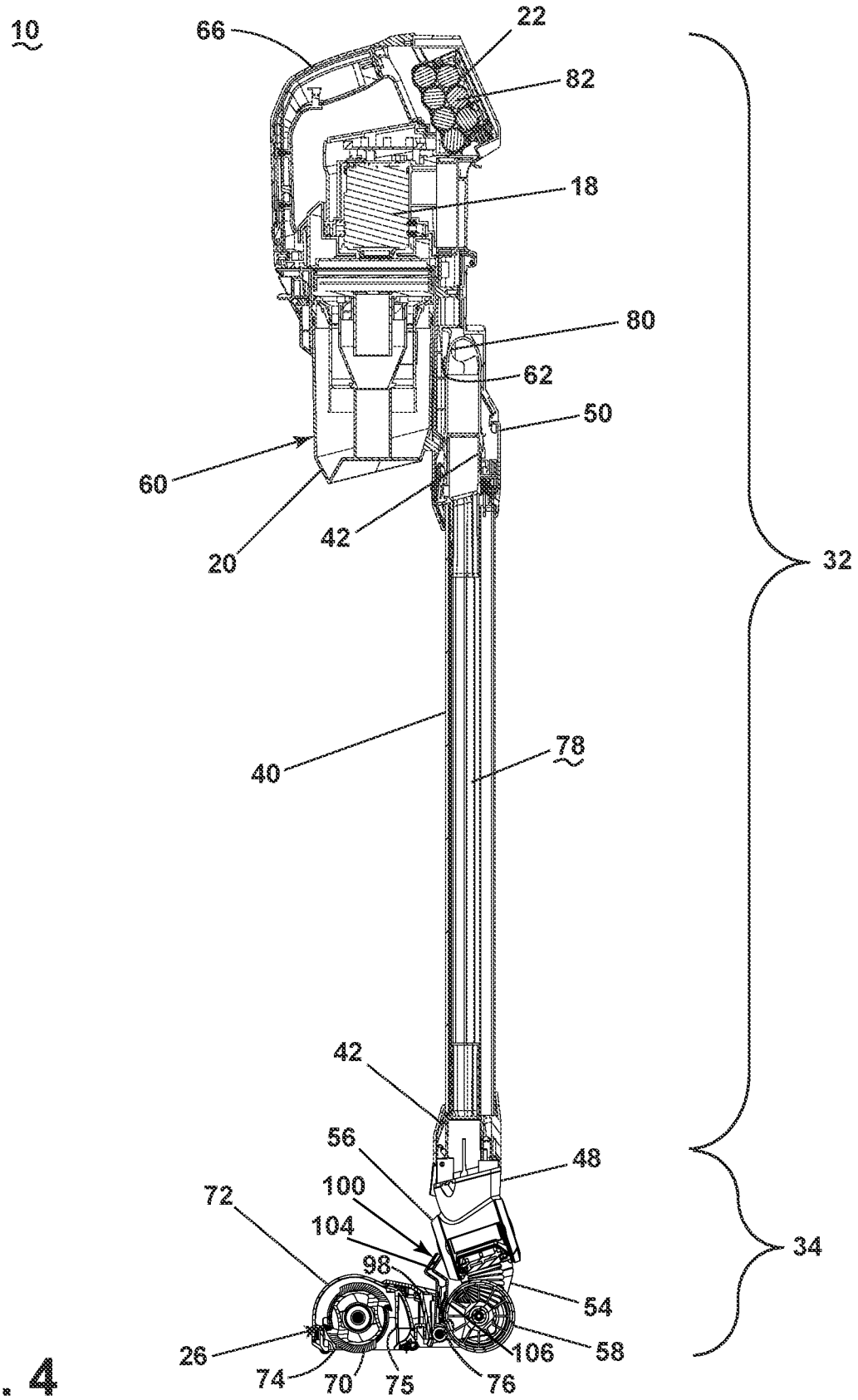
FIG. 4 is a side sectional view of the vacuum cleaner including the brake assembly of FIG. 2 along line IV-IV.

Referring now to FIG. 4, a recovery airflow conduit 75 can be formed between the agitator housing 72 and the dirt separation and collection module 60. For example, a hose conduit 76 in the base assembly 34 can be fluidly coupled to a wand central conduit 78 within the wand 40. The hose conduit 76 can be flexible to facilitate pivoting movement of the swivel joint assembly 52 about multiple axes. The wand central conduit 78 is fluidly connected to a dirt inlet 80 on the dirt separation and collection module 60 via the air outlet port 62.

In the illustrated example, the power source 22 is in the form of a battery pack 82 containing one or more batteries, such as lithium-ion (Li-Ion) batteries. Optionally, the vacuum cleaner 10 can include a power cord (not shown) to connect to a wall outlet. In still another example, the battery pack 82 can include a rechargeable battery pack, such as by connecting to an external source of power to recharge batteries contained therein.

During operation of the vacuum cleaner 10, the power source 22 can supply power for the suction source 18, such as by way of non-limiting example a motor/fan assembly to provide suction through the recovery airflow conduit 75. Debris-laden working air within the agitator housing 72 can be directed through the flexible hose conduit 76 and wand central conduit 78 before flowing into the dirt separation and collection module 60 by way of the dirt inlet 80 as shown. In addition, the swivel joint assembly 52 can provide for forward/backward and side-to-side pivoting motion of the upright assembly 32 with respect to the base assembly 34 when moving the base assembly 34 across the surface to be cleaned. Additional details of the motor/fan assembly are described in U.S. Pat. No. 10,064,530, issued Sep. 4, 2018, which is incorporated herein by reference in its entirety.

Figure 5:
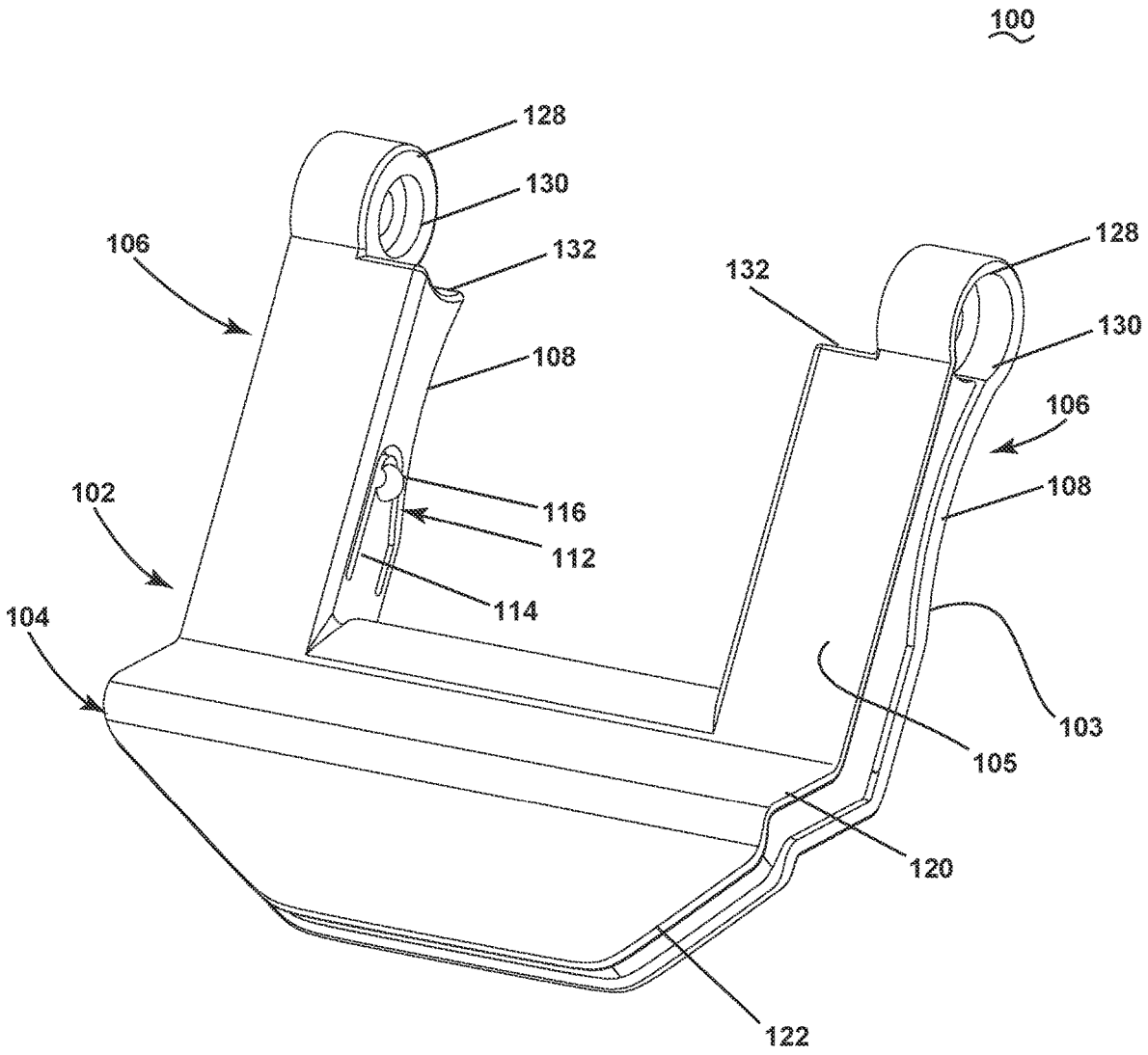
FIG. 5 is a perspective view of the brake assembly of FIG. 2.

FIG. 5 is a perspective view of the body 102 of the brake assembly 100 of FIG. 2. As illustrated, the body 102 can include the handle 104 and a set of legs 106. In a of non-limiting example, the two legs 106 are spaced from one another. The handle 104 can extend from a portion of one of the legs 106 to a corresponding portion of the adjacent leg 106. As such, the handle 104 can span the space between the set of legs 106 and operatively couple the legs 106 to one another. Although illustrated as a brake assembly 100 including two legs 106, it will be appreciated that there can be any number of one or more legs 106. For example, the brake assembly 100 can include a single leg 106 with the handle 104 projecting outward from a portion of the leg 106. The body 102 can be further defined by a first side 103 and a second side 105 opposite the first side 103.

The handle 104 can include a first portion 120 and a second portion 122. The first portion 120 can be directly coupled to the set of legs 106, while the second portion 122 can be spaced from the set of legs 106 and define a distal end of the brake assembly 100. The first portion 120 can extend in a direction oblique to a direction of extension of the second portion 122. As such, the first portion 120 can be obliquely oriented with respect to the second portion 122. Alternatively, the first portion 120 can be normal to the second portion 122. In either case, the first portion 120 and the second portion 122 are non-parallel. This orientation of the first portion 120 and the second portion 122 can form a grip of the handle 104 such that the user can easily grasp the handle 104 of the brake assembly 100. As such, the brake assembly 100 can be further defined as a brake assembly 100 including an ergonomic handle 104.

The set of legs 106 are illustrated as extending from the first portion 120 of the handle 104. Each leg 106 can extend in the same direction away from the section of the body 102 defining the handle 104. In the illustrated example, the legs 106 can be spaced from one another and the width of the handle 104 span the space between the set of legs 106. Further, the set of legs 106 are illustrated to be parallel to one another, however, it will be appreciated that he legs 106 can be non-parallel.

Each leg 106 can include a foot 128 defining a distal end of the set of legs 106, opposite a handle 504. The foot 128 can extend across only a portion of the width of each leg 106. By way of non-limiting example, the foot 128 can extend across 50% of the width of a corresponding leg 106. In one non-limiting example, the foot 128 can be formed as a cylinder. It will be appreciated, however, that the foot 128 can have any suitable geometric configuration. A remaining 50% of the width of the leg 106 that does not include the foot 128 can include a cut out 132 with a shape corresponding to the foot 128. As such, the cut out 132 can be formed as a cylindrical cut out 132 along a distal portion of the legs 106. Alternatively, the foot 128 can extend the same width as the leg.

A passageway or through hole 130 can extend through a portion of the foot 128 from one end or side to the other. In the non-limiting example illustrated, the through hole 130 can be formed as a concentric cylinder within the cylinder defined by the foot 128. It is contemplated, by way of non-limiting example, as illustrated, that the through hole 130 can have a varying cross-sectional area from one end of the foot 128 to the other. For example, the cross-sectional area of the through hole 130 can be larger at one end to define a seat for a fastener that can be used to couple the brake assembly 100 the vacuum cleaner 10. It will be appreciated, however, that the through hole 130 can have any suitable cross-sectional area along any portion of the through hole 130. For example, the through hole 130 can have a constant cross-sectional area.

The set of legs 106 can further include a set of grooves 108 provided on the first side 103 of the body 102. The set of grooves 108 can define a portion of the body 102 where the first side 103 converges toward the second side 105. In other words, the set of grooves 108 can define a depression formed within the body 102 of the brake assembly 100. By way of non-limiting example, the set of grooves 108 can be within a portion of the set of legs 106. As illustrated, the set of grooves 108 can be formed as a rounded, concave portion of the set of legs 106. Alternatively, the set of grooves 108 can be formed as any suitable geometric portion depression of concave portion of the set of legs 106.

A lock 112 can be included along an interior portion of the set of legs 106. The lock 112 can confront the space between the set of legs 106 although it is contemplated that it could be located on the exterior. The lock 112 can include an arm 114 connected to a corresponding leg 106 at one end. The remainder of the arm 114 can be separated from the body of the corresponding leg 106 thus forming a gap between the arm 114 and the leg 106, as illustrated. The gap can extend around the entirety of the arm 114 besides where the arm 114 connects to the set of legs 106. A protrusion 116 can extend away from a distal end of the arm 114 and confront the space between the set of legs 106. The protrusion 116 is illustrated, by way of non-limiting example as a in the form of a semi-sphere. Although illustrated as a single lock 112 on a single leg 106, it will be appreciated that there can be any number of locks 112. For example, each leg 106 of the set of legs 106 can include a lock 112 on the interior portion of the corresponding leg 106.

The arm 114 can include a section having a different shape, profile, configuration, size, etc. from a remainder of the arm 114. As a non-limiting example, the profile of the arm 114 can remain constant. Alternatively, the profile or width of the arm 114 can vary along the length of the arm 114. It will be appreciated that the arm 114 can have any suitable profile and that the width, shape, profile, size, or thickness can vary along the length of the arm 114 constantly, linearly, non-constantly, or non-linearly.

As illustrated, the body 102 of the brake assembly 100 is hollow such that a void is formed between the first side 103 and the second side 105. As a portion of the arm 114 is separated from the body of the set of legs 106, it will be appreciated that the lock 112 can move at least partially into the void from the illustrated position by applying a force onto a portion of the lock 112. As a non-limiting example, the protrusion 116 of the lock 112 can move at least partially into the void of the set of legs 106. As such, the lock 112 can be further defined as a spring biased to an original position (e.g., the illustrated position where an outer surface of the arm 114 is aligned with the outer surface of the corresponding leg 106).

Figure 6:
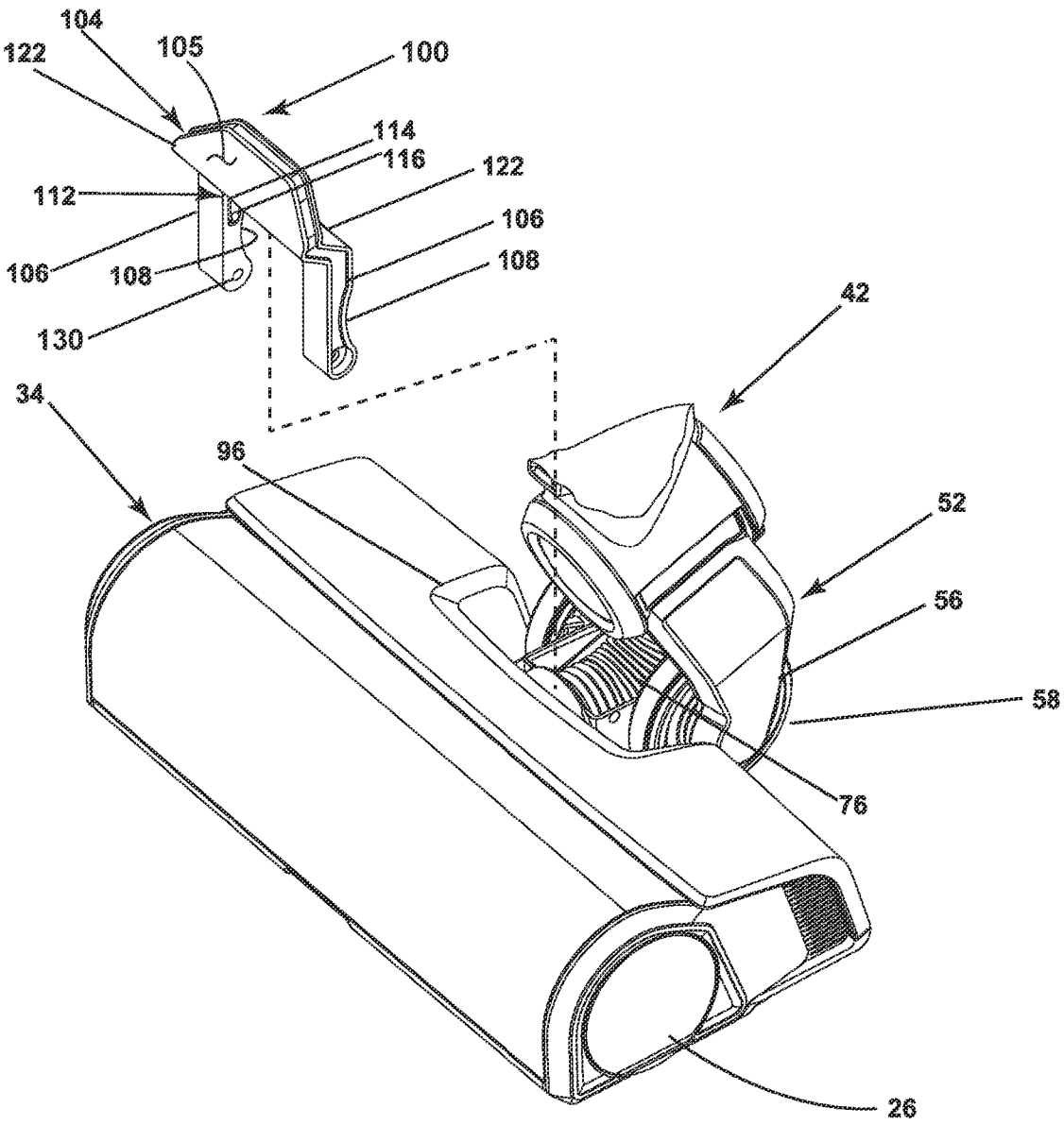
FIG. 6 is a perspective view of the base assembly of FIG. 2 with the brake assembly exploded.

FIG. 6 is an exploded perspective view of the brake assembly 100 and the base assembly 34 of FIG. 2. As illustrated, the base assembly 34 can include a brake housing 96. The wheels 58 can extend into at least a portion of the brake housing 96. The hose conduit 76 can extend through the brake housing 96 between the wheels 58, thus diving the brake housing 96 into two separate areas. The brake assembly 100 can straddle the hose conduit 76 such that each leg 106 extends into a corresponding area of the brake housing 96.

Figure 7:
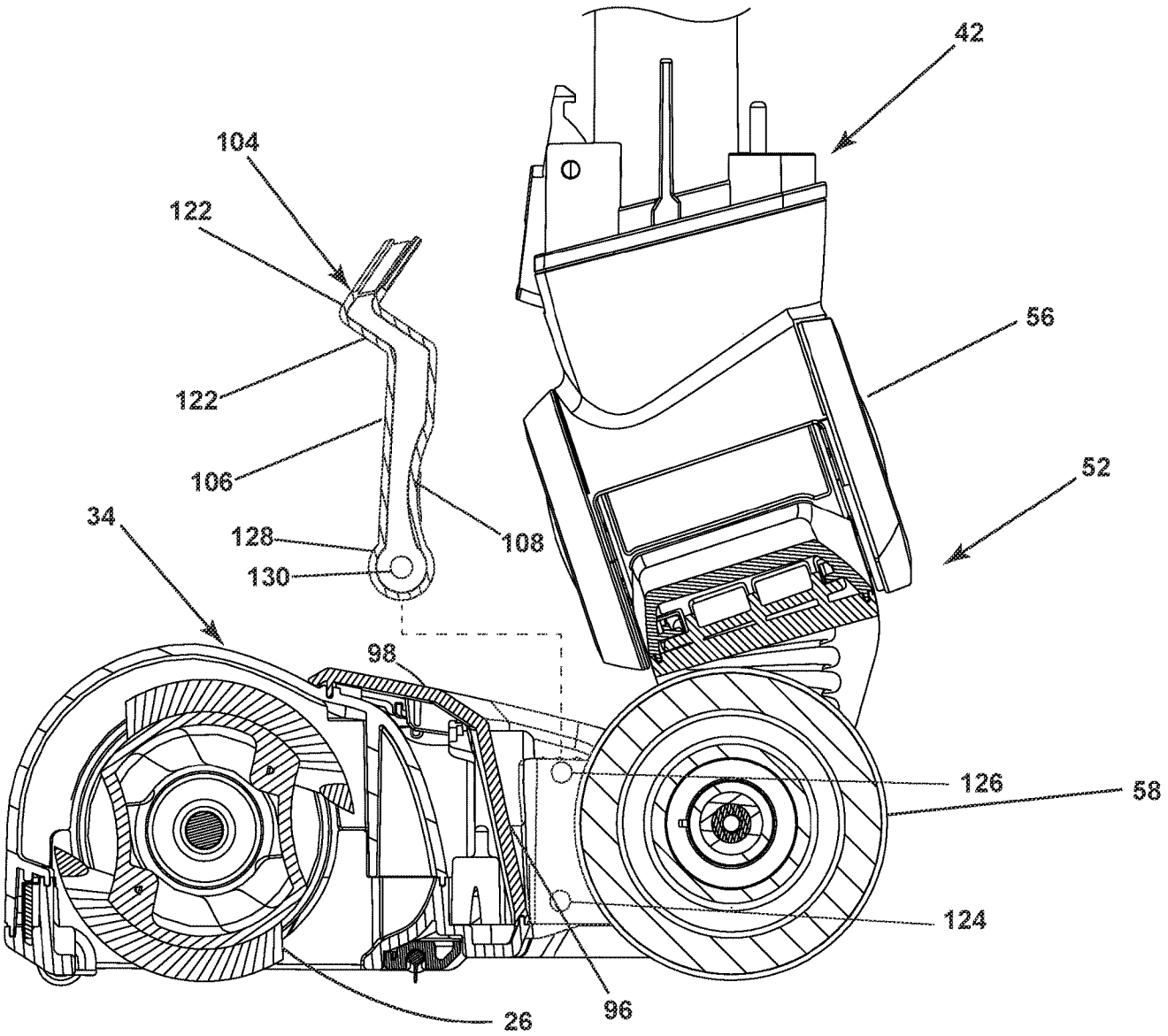
FIG. 7 is a sectional view of the base assembly of FIG. 6, taken along line VII-VII of FIG. 2, and with the brake assembly exploded.

FIG. 7 is a sectional view of the brake assembly 100 and the base assembly 34 of FIG. 6, as seen from cut VII-VII of FIG. 2, and with the brake assembly 100 exploded from the base assembly 34. The base assembly 34 can further include a projection 124 and a divot 126.

When the brake assembly 100 is positioned within the base assembly 34, the projection 124 can rest within or against the cut out 132. It is contemplated that a portion of the projection 124 can extend into at least a portion of the through hole 130, thus coupling the brake assembly 100 to the base assembly 34. The foot 128 including the through hole 130, the cut out 132, and the projection 124, together, can define a center of rotation of the brake assembly 100 and a first point of coupling between the base assembly 34 and the brake assembly 100.

At least a portion of the lock 112 can be releasably secured within the divot 126. The protrusion 116 can be releasably secured within the divot 126. As such, the divot 126 can define a second point of coupling between the brake assembly 100 and the base assembly 34.

Figure 8:
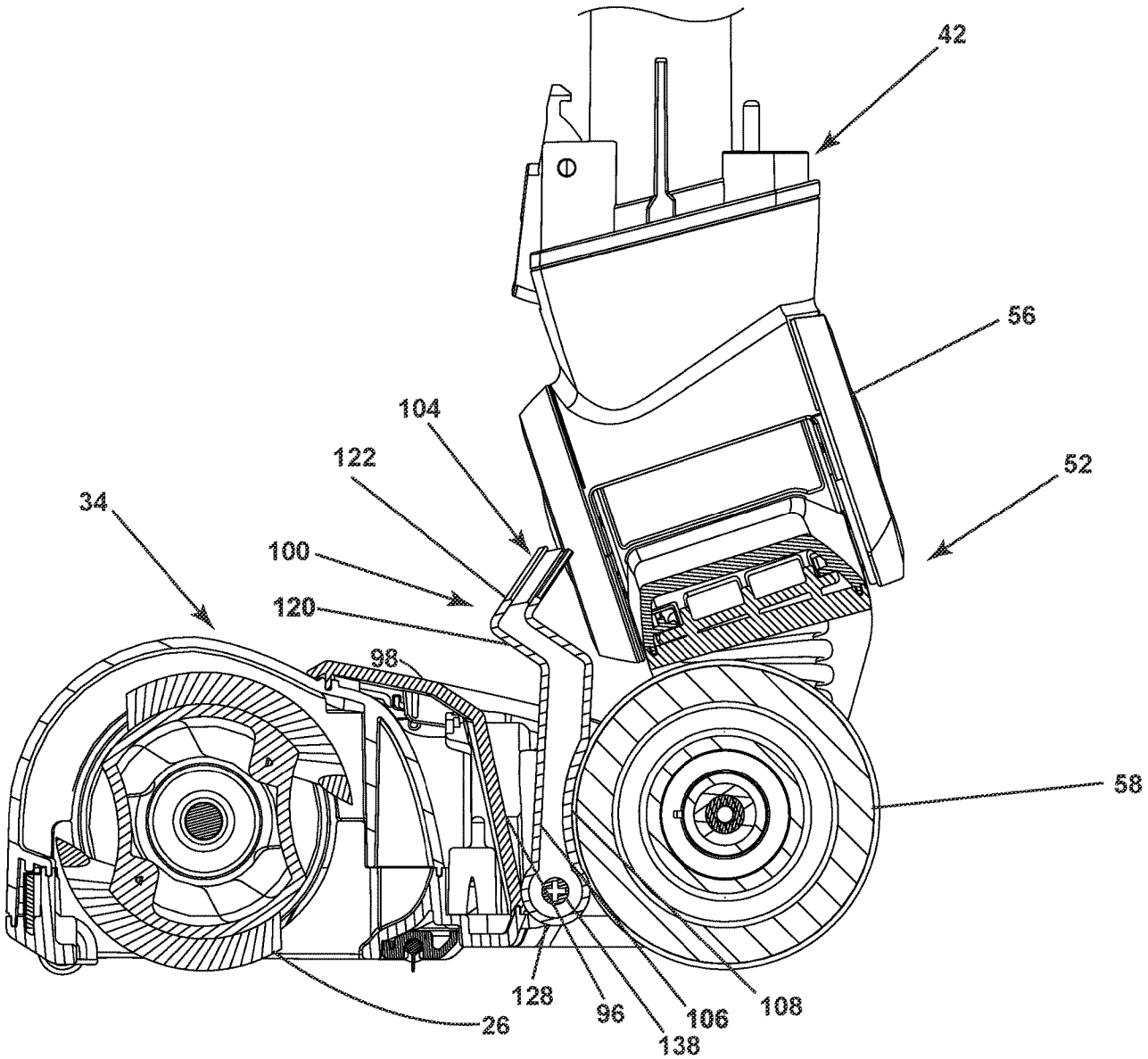
FIG. 8 is the sectional view of the base assembly of FIG. 7, including the brake assembly non-exploded and in a first position.

FIG. 8 is the sectional view of the base assembly 34 of FIG. 7, as seen from cut VII-VII of FIG. 2, with the brake assembly 100 no longer exploded from the base assembly 34. As illustrated, the brake assembly 100 is in a first position or a locked position.

As illustrated, the groove 108 of one of the legs 106 confronts or otherwise is in direct contact with at least one of the wheels 58. Although only one of the legs 106 is illustrated to be in contact with one wheel 58, it will be appreciated that this description can be applied to any leg 106 of the set of legs 106. As such, in the case of the brake assembly 100, one leg 106 can confront a wheel 58 while another adjacent leg 106 can confront a separate, adjacent wheel 58.

It is contemplated, however, that the projection 124 can further be defined as a bore such that a fastener 138 can be threaded through the through hole 130 of the brake assembly 100 and into a portion of the projection 124. As such, the fastener 138 can couple the brake assembly 100 to the base assembly 34. The fastener 138, the foot 128 including the through hole 130, the cut out 132, and the projection 124, together, can define the center of rotation of the brake assembly 100. As a non-limiting example, the fastener can be any suitable fastener such as, but not limited to, a push pin, a tab, a pin, a screw, a nail, a protrusion, or any combination thereof.

In the first position, the lock 112 of the brake assembly 100 is engaged within a corresponding portion of the base assembly 34. As a non-limiting example, the protrusion 116 of the lock 112 is engage within the divot 126 of the base assembly 34. This engagement prevents unintentional rotational movement of the brake assembly 100. In other words, the brake assembly 100 will not move from the first position unless an external force is applied to the brake assembly 100. As such, the groove 108 remains in contact with the wheels 58. The external force can be any suitable force that can cause the arm 114 to move inward from its biased position. For example, the external force can be, but is not limited to, a user moving the brake assembly 100 over a portion of the base assembly 34 that projects toward the lock 112 and will cause the lock 112 to move inward when moved over it.

In the first position, the protrusion 116 of the lock 112 is positioned within the divot 126 (FIG. 7), thus locking the brake assembly in the illustrated position. As used herein, the term "locked", "locking", "lock" or iterations thereof refers to the prevention or limitation of movement of a moveable object (e.g., the brake assembly 100). Although discussed in terms of the protrusion 116 of the lock 112 fitting within the divot 126 to lock the brake assembly 100 in the first position, it will be appreciated that any other suitable locking mechanism can be used such as, but not limited to, a spring, a hook, a magnet, a lever, a body moveable between different set positions such as through a series of detents, or any combination thereof. The engagement between the grooves 108 and the wheels 58 prevents the rotation of the wheels 58. As such, when the brake assembly 100 is in the first position, the wheels 58 will not rotate as they are locked in position. Further, when in the first position, at least a portion of the vacuum cleaner 10 can rest against or otherwise contact the handle 104. As a non-limiting example, when in the first position, at least a portion of the vacuum cleaner 10 can rest against the second portion 122 of the handle 104. As illustrated, the upper portion 56 of the swivel joint assembly 52 can rest against the second portion 122 of the handle 104. As such, the vacuum cleaner 10 can be stood upright, and remain upright, by positioning the brake assembly 100 in the first position as illustrated.

Figure 9:
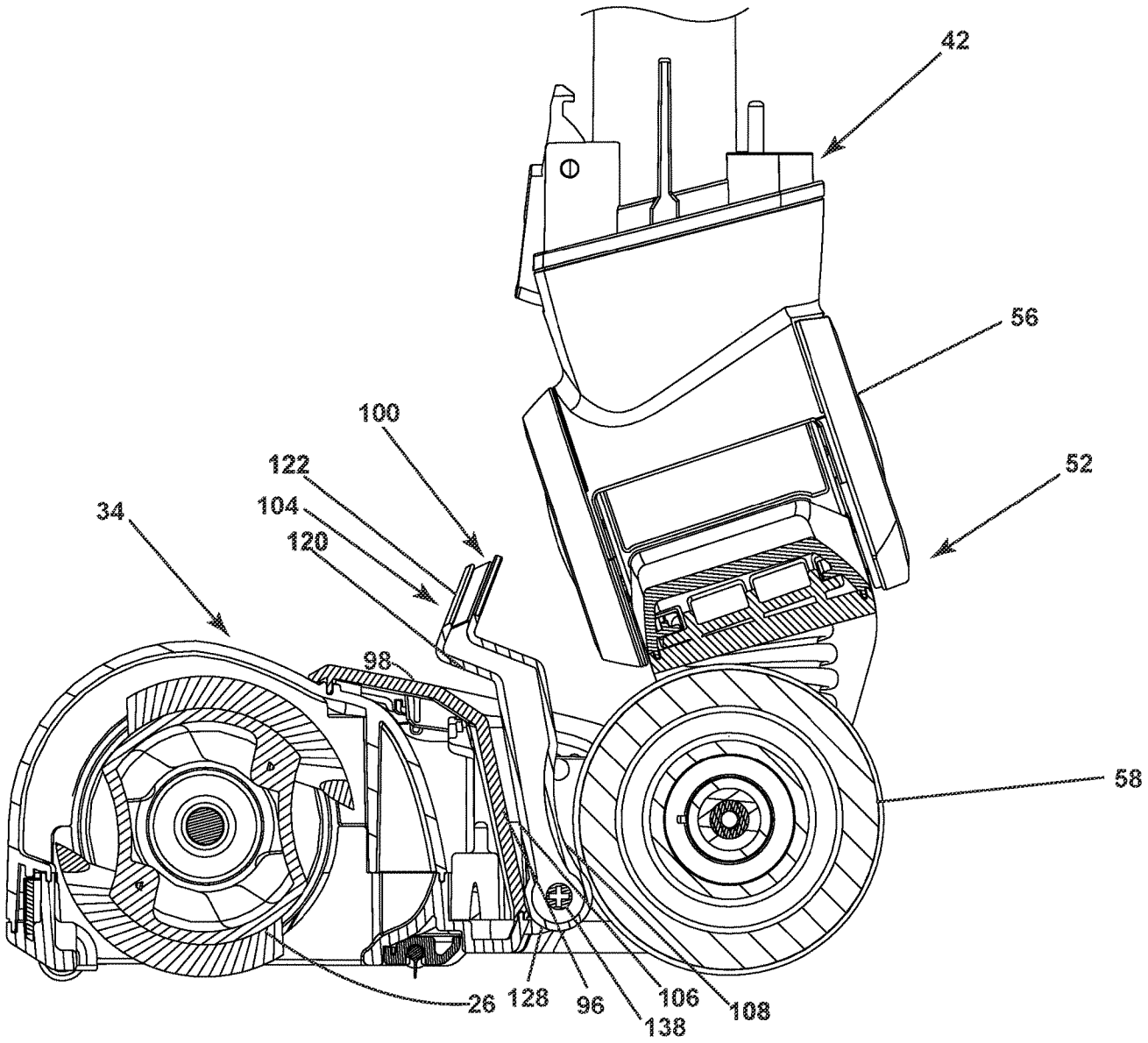
FIG. 9 is the sectional view of the base assembly of FIG. 8, with the brake assembly in a second position.

FIG. 9 is the sectional view of the base assembly 34 of FIG. 8, as seen from cut VII-VII of FIG. 2. As illustrated, the brake assembly 100 is in a second position defined as an unlocked position.

In the second position, the grooves 108 the set of legs 106 are no longer in contact with the wheels 58. The protrusion 116 of the lock is removed from the divot 126. As such, the wheels 58 are not engaged by a portion of the brake assembly 100. As such, the wheels 58 are free to rotate. When in the second position, the brake assembly 100 can rest against the base assembly 34. As a non-limiting example, the brake assembly 100 can rest against an inner wall of the brake housing 96 although this need not be the case. Further, in the second position, the swivel joint 52 no longer contacts the handle 104. As such, the upright assembly 32 of the vacuum cleaner 10 is free to swivel about a pivot defined by the joint assembly 52.

In operation, the brake assembly 100 can transition between the first position and the second position to selectively engage the wheels 58. In the first position, the grooves 108 of the brake assembly 100 can contact the wheels 58, thus restricting rotational movement of the wheels 58. In the second position, the brake assembly 100 can be displaced from or otherwise not contact the wheels 58, thus allowing for the free rotational movement of the wheels 58. As discussed herein, the brake assembly 100 can be selectively locked or unlocked. This selective locking can be done at least partially through the lock 112. As a non-limiting example, the selective locking can be determined by whether or not the protrusion 116 of the lock is engaged with or otherwise positioned within the divot 126 of the base assembly 34.

During the locking and unlocking of the brake assembly 100, the lock 112 is compressed inward into the hollow portion the leg 106 when the external force is applied to the brake assembly 100. As a non-limiting example, the arm 114 of the lock 112 is compressed inward into the hollow portion of the leg 106 when the external force is applied to the brake assembly 100. Once the brake assembly 100 is rotated such that the protrusion 116 overlays the divot 126, the arm 114 will "snap-back" or otherwise move back to the position it biases (the position illustrated in FIG. 5). As such, the protrusion 116 will be nested within the divot 126, and the brake assembly 100 will be locked in place. The external force can once again be applied to rotate the brake assembly 100. The arm 114 will once again be compressed inward into the hollow of the legs 106 and the protrusion will be removed from the divot 126. As such, the brake assembly 100 will be unlocked from the first position. As a non-limiting example, the external force can be from moving a portion of the vacuum cleaner 10 and contacting the brake assembly 100. For example, the user can push the upright assembly 32 forward such that a portion of the upper portion 56 of the swivel joint assembly 52 can come apply a force to a portion of the brake assembly 100. In the illustrated example, the second portion 122 of the handle 104. This, in turn, can cause the brake assembly 100 to unlock from the first position and rotate toward the second position, thus unlocking the wheels 58 through movement of the swivel joint assembly 52.

This method of moving the brake assembly 100 can be used during operation of the vacuum cleaner 10 when it is desired to lock or stop movement of the wheels 58, as discussed herein. Further yet, in the first position, the upright assembly 32 can confront a portion of the brake assembly 100 thus propping-up or retaining the upright assembly 32 in the upright position. If the brake assembly 100 were not present, the wheels 58 would be free to rotate. The weight from the upright assembly 32 and hand-held portion 36 could then cause the wheels 58 to rotate and the base assembly 34 would "slide out" from the remainder of the vacuum cleaner 10. As used herein, the phrase "slide out" can refer to the unintentional and undesired movement of the base assembly 34 through rotation of the wheels 58 that can cause the upright assembly 32 and hand-held portion 36 to fall from its upright position. This can ultimately result in at least a portion of the vacuum cleaner 10 falling to the ground or against a surrounding object. The implementation of the brake assembly 100, however, ensures that the base assembly 34 cannot slide out from underneath the remainder of the vacuum cleaner 10 when the brake assembly 100 is secured in the first position. This eliminates the risk of at least a portion of the vacuum cleaner 10 falling to the ground or against a surrounding object.

Figure 10:
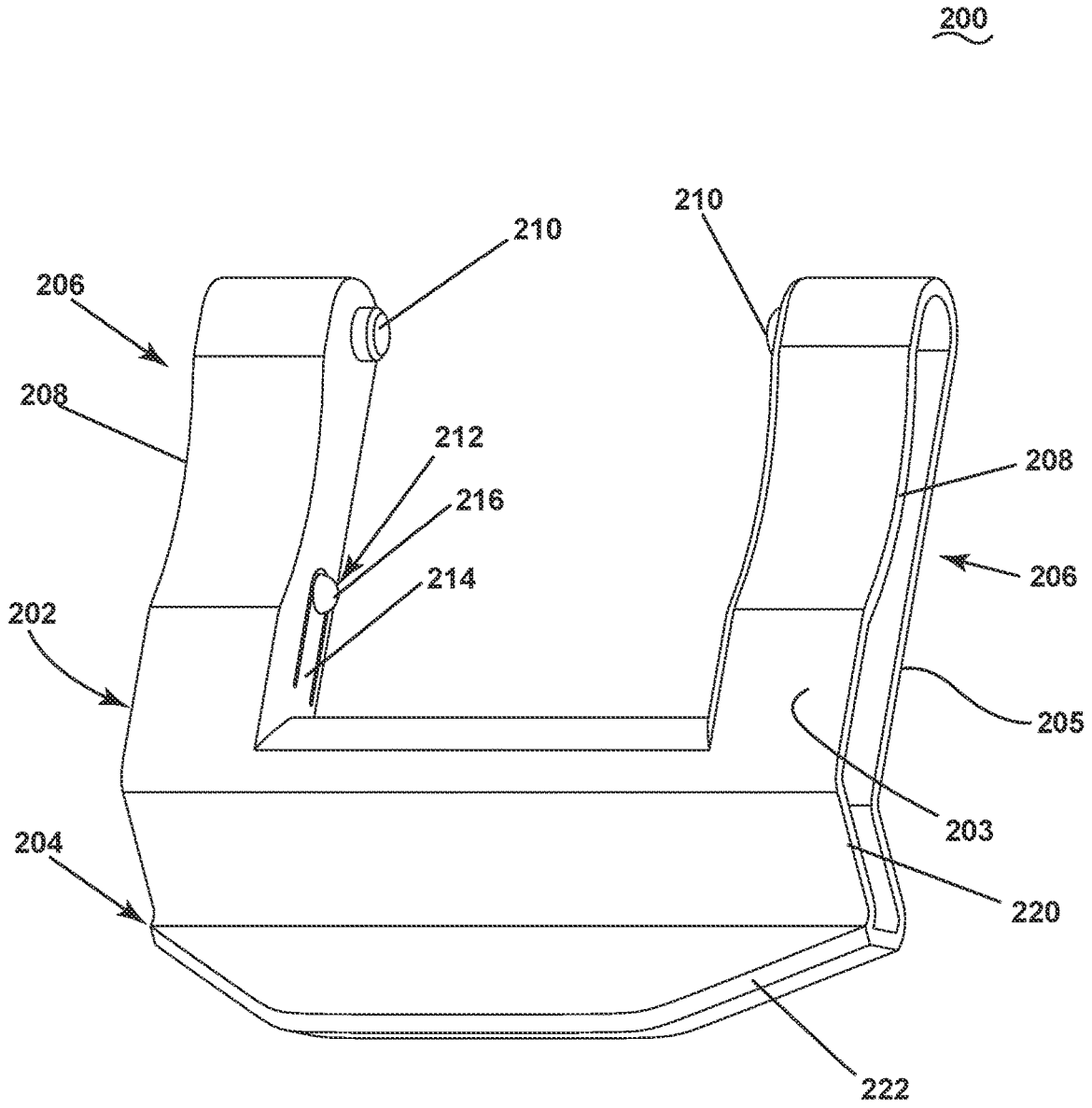
FIG. 10 is a perspective view of another exemplary brake assembly that can be utilized in the vacuum cleaner of FIG. 2.

FIG. 10 illustrates another non-limiting example of a brake assembly 200. The brake assembly 200 is similar to the brake assembly 100; therefore, like parts will be identified with like numerals in the 200 series, with it being understood that the description of the like parts of the brake assembly 100 applies to the brake assembly 200 unless otherwise noted.

The brake assembly 200 can include a set of legs 206 similar to the set of legs 106 of the brake assembly 100, but without the set of feet 128. Alternatively, the set of legs 206 can include the set of feet 128. The difference being that the set of legs 206 do not include the foot 128. Instead, the set of legs 206 have a constant width from one distal end to the other. The set of legs 206 can each further include a knob 210 extending from an inner portion of the set of legs 206 and confronting the space between the set of legs 206. It is contemplated that the knob 210 can define both a point of coupling and a pivot point of the brake assembly 200. As a non-limiting example, the projection 124 can instead be formed as a divot or include a bore such that the knob 210 can be secured within the projection 124 of the base assembly 34. The knob 210, and the projection 124 can form the center of rotation and a point of coupling between the brake assembly 200 and the base assembly 34.

The brake assembly 200 can further include a lock 212 including an arm 214 and a protrusion 216 extending from the arm 214. The lock 212 is similar to the lock 112 except that the arm 214 of the lock 212 has a constant thickness or otherwise extends linearly from one distal end coupling the arm to the legs 206 to another distal end where the protrusion 216 extends from the arm 214.

Figure 11:
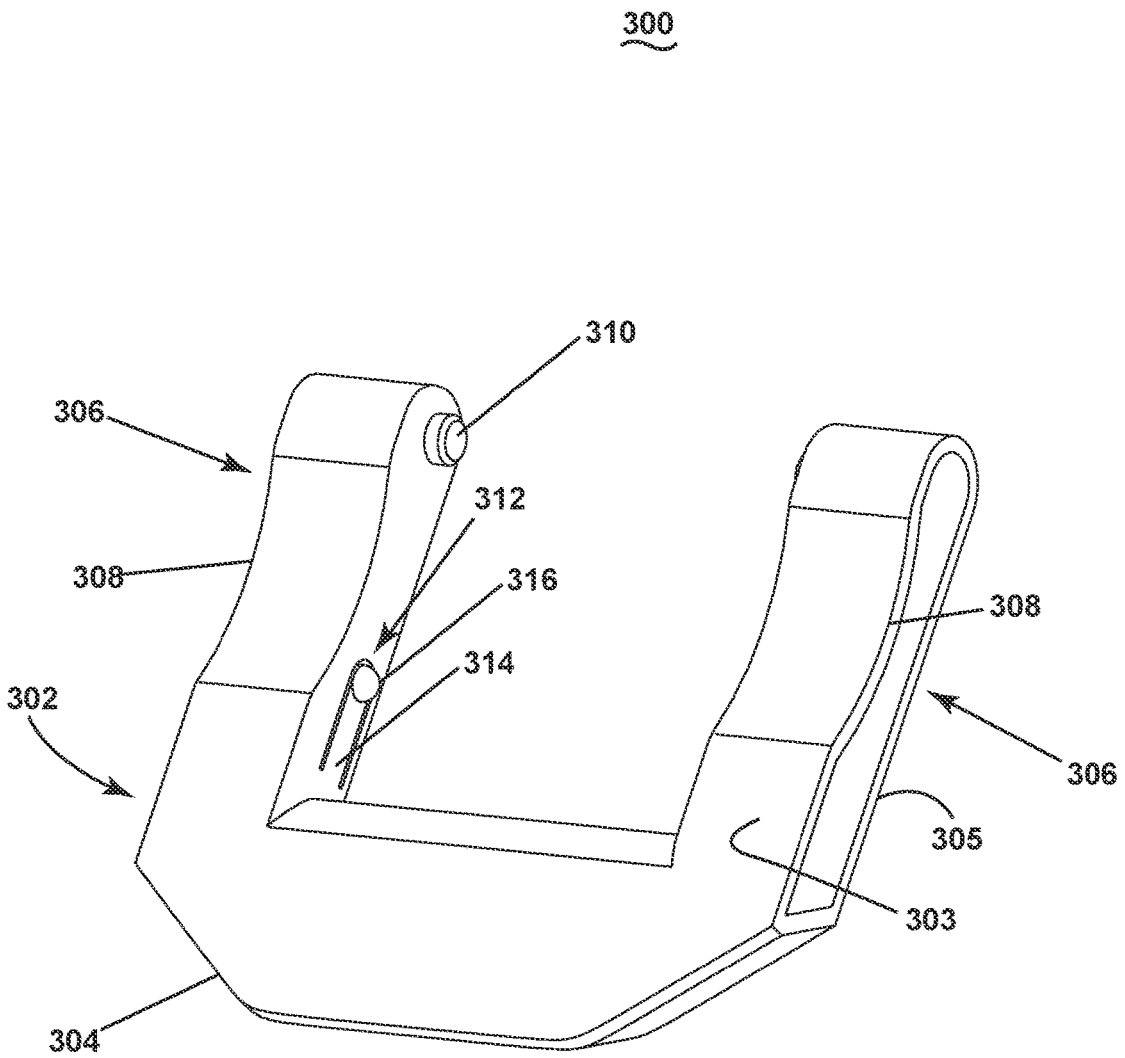
FIG. 11 is a perspective view of yet another exemplary brake assembly that can be utilized in the vacuum cleaner of FIG. 2.

FIG. 11 illustrates another non-limiting example of a brake assembly 300. The brake assembly 300 is similar to the brake assembly 100, 200; therefore, like parts will be identified with like numerals in the 300 series, with it being understood that the description of the like parts of the brake assembly 100, 200 applies to the brake assembly 300 unless otherwise noted.

The brake assembly 300 can include a set of legs 306 without the set of feet 128 of the brake assembly 100. Alternatively, the brake assembly 300 can include the set of feet 128. One difference is that the brake assembly 300 can further include a handle 304 formed as a monolithic body without the first portion 120, 220 (e.g., the angled portion) of the handle 104, 204 included with the brake assembly 100, 200. As used herein, the term "monolithic body", "integral monolithic body", or iterations thereof can refer to a single body that is a single, non-separable piece, or formed as a single unitary piece at manufacture, as opposed to being formed by combining separate elements into one during manufacture. The formation of the brake assembly 300 as a monolithic body can allow for a smaller handle 304 that does not extend as far away from the base assembly 34 when compared to the corresponding portions of the brake assembly 100, 200. As a non-limiting example, the formation of the handle 304 as a monolithic body can allow for a smaller handle 304 that does not extend as far away from the base assembly 34 when compared to the corresponding portions of the brake assembly 100, 200.

Figure 12:
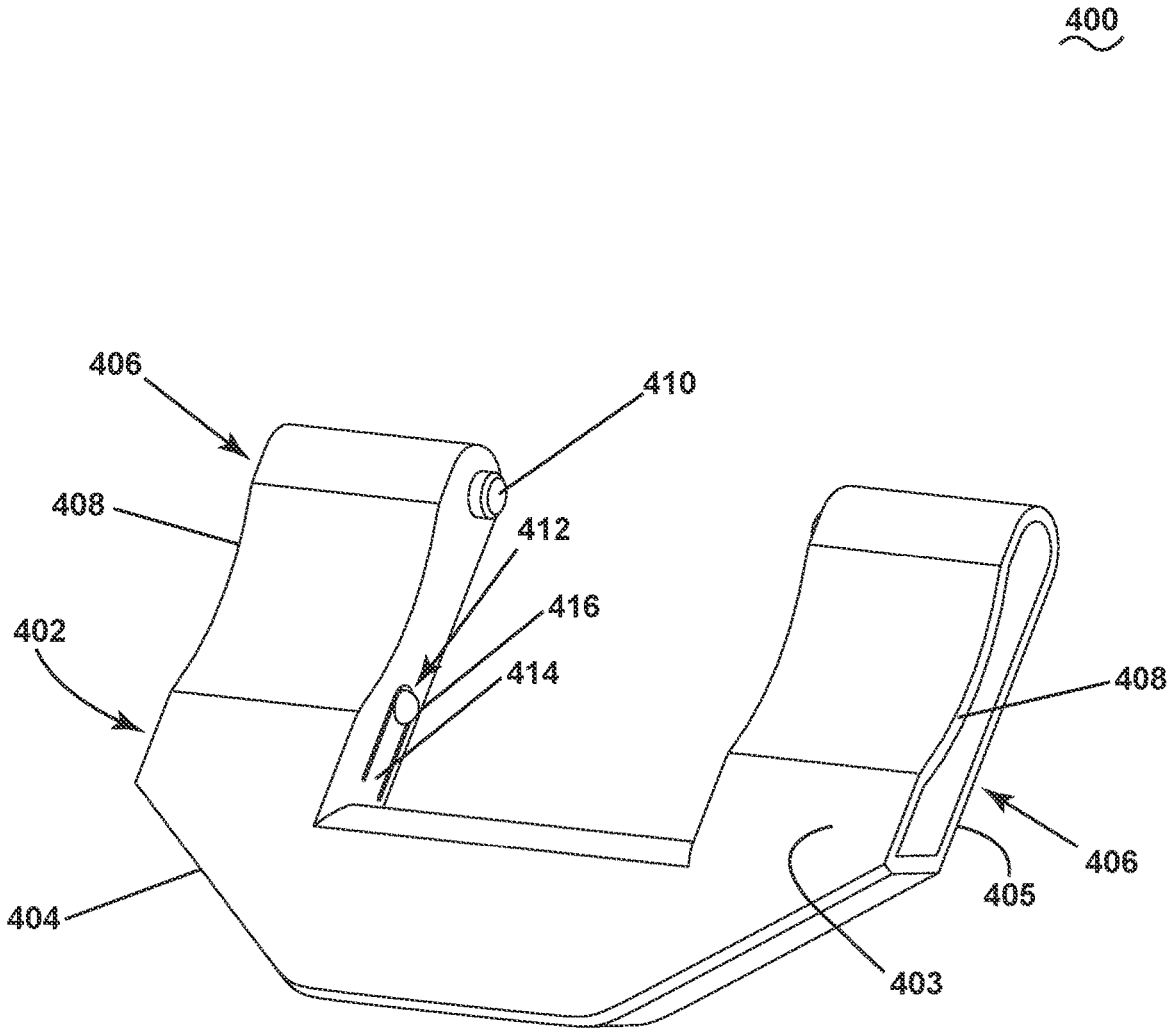
FIG. 12 is a perspective view of yet another exemplary brake assembly that can be utilized in the vacuum cleaner of FIG. 2.

FIG. 12 illustrates another non-limiting example of a brake assembly 400. The brake assembly 400 is similar to the brake assembly 100, 200, 300; therefore, like parts will be identified with like numerals in the 400 series, with it being understood that the description of the like parts of the brake assembly 100, 200, 300 applies to the brake assembly 400 unless otherwise noted.

The brake assembly 400 can include a set of legs 406 without the set of feet 128 of the brake assembly 100. Alternatively, the set of legs 406 can include he set of feet 128. The set of legs 406 can each include a groove 408, similar to the set of legs 106, 206, 306, and the groove 108, 208, 308 of the brake assembly 100, 200, 300. The legs 406, however, and hence the grooves 308 have an increased width when compared to the corresponding portions of the brake assembly 100, 200, 300. For example, the width of the set of legs 406, and hence the set of grooves 408, can two times as large as the width of the corresponding portions of the brake assembly 100, 200, 300. It will be appreciated, however, that the width of the legs 406 can be any times greater than the corresponding portions of the brake assembly 100, 200, 300.

The increased width of the set of legs 406, and the grooves 408 can allow for a greater surface area of the brake assembly 400 to engage the wheels 58 of the vacuum cleaner 10. This, in turn, can increase a frictional force applied to the wheels 58 by the set of legs 406 when compared to the corresponding portions of the brake assemblies 100, 200, 300. This ultimately increases the efficiency of the brake assembly 400 as a surface area of the wheels 58 that are engaged by the brake assembly 400, the less likely the wheels 58 will rotate. It is yet further contemplated that the brake assembly 400 can engage more than one wheel 58 per groove 408. For example, each groove 408 can be configured to engage two adjacent wheels 58.

Figure 13:
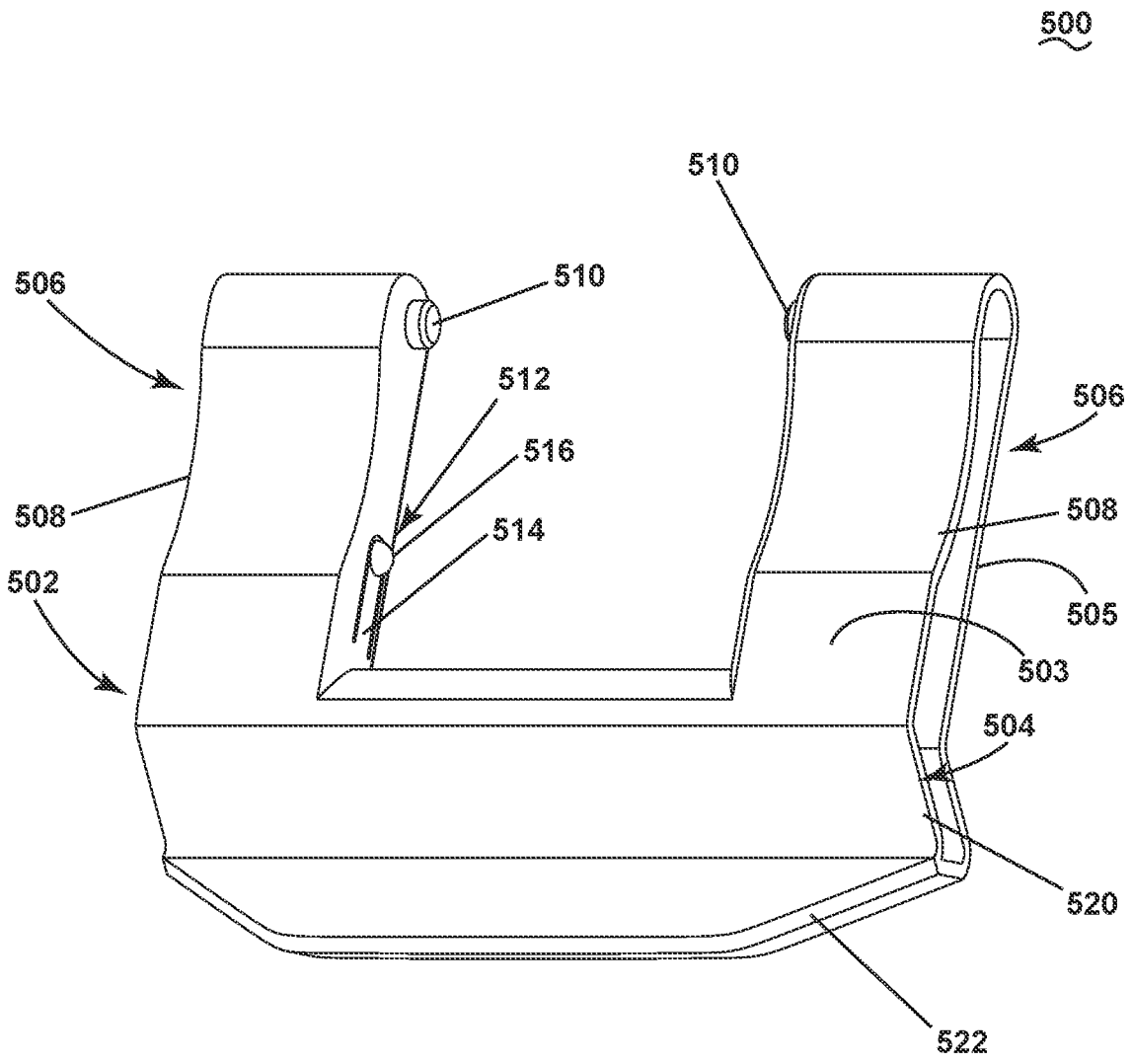
FIG. 13 is a perspective view of yet another exemplary brake assembly that can be utilized in the vacuum cleaner of FIG. 2.

FIG. 13 illustrates another non-limiting example of a brake assembly 500. The brake assembly 500 is similar to the brake assembly 100, 200, 300, 400; therefore, like parts will be identified with like numerals in the 500 series, with it being understood that the description of the like parts of the brake assembly 100, 200, 300, 400 applies to the brake assembly 500 unless otherwise noted.

The brake assembly 500 can include a set of legs 506 without the set of feet 128 of the brake assembly 100. Alternatively, the brake assembly 500 can include the set of feet 128. The brake assembly 500 is a combination of the brake assembly 100, 200 of FIG. 5 and FIG. 10, respectively, and the brake assembly 400 of FIG. 12. As such, the brake assembly 500 includes the set of legs 506, and groove 508 with a larger width similar to the corresponding parts of the brake assembly 400. The brake assembly 500 further includes the handle 504 with a first portion 520 and a second portion 522 similar to the corresponding portions of the brake assembly 100, 200, 400. As such, the brake assembly 500 can be defined as a brake assembly 500 that exerts a larger frictional force on the wheels 58, while also including an ergonomically efficient handle 504. Additional details of other exemplary brake assemblies and other features that can be utilized with the vacuum cleaner 10 are described in U.S. Patent Application No. 63/291,675, filed Dec. 20, 2021, which is incorporated herein by reference in its entirety.

FIGS. 14-17 illustrate another non-limiting example of a base assembly 34' with a brake assembly 600, which can be utilized with the vacuum cleaner 10. The base assembly 34' is similar to the base assembly 34; therefore, like parts will be identified with like numerals, with it being understood that the description of the like parts of the base assembly 34 applies to the base assembly 34' unless otherwise noted. The brake assembly 600 is similar to the brake assemblies 100, 200, 300, 400, 500; therefore, like parts will be identified with like numerals in the 600 series, with it being understood that the description of the like parts of the brake assembly 100, 200, 300, 400, 500 applies to the brake assembly 600 unless otherwise noted.

Figure 14:
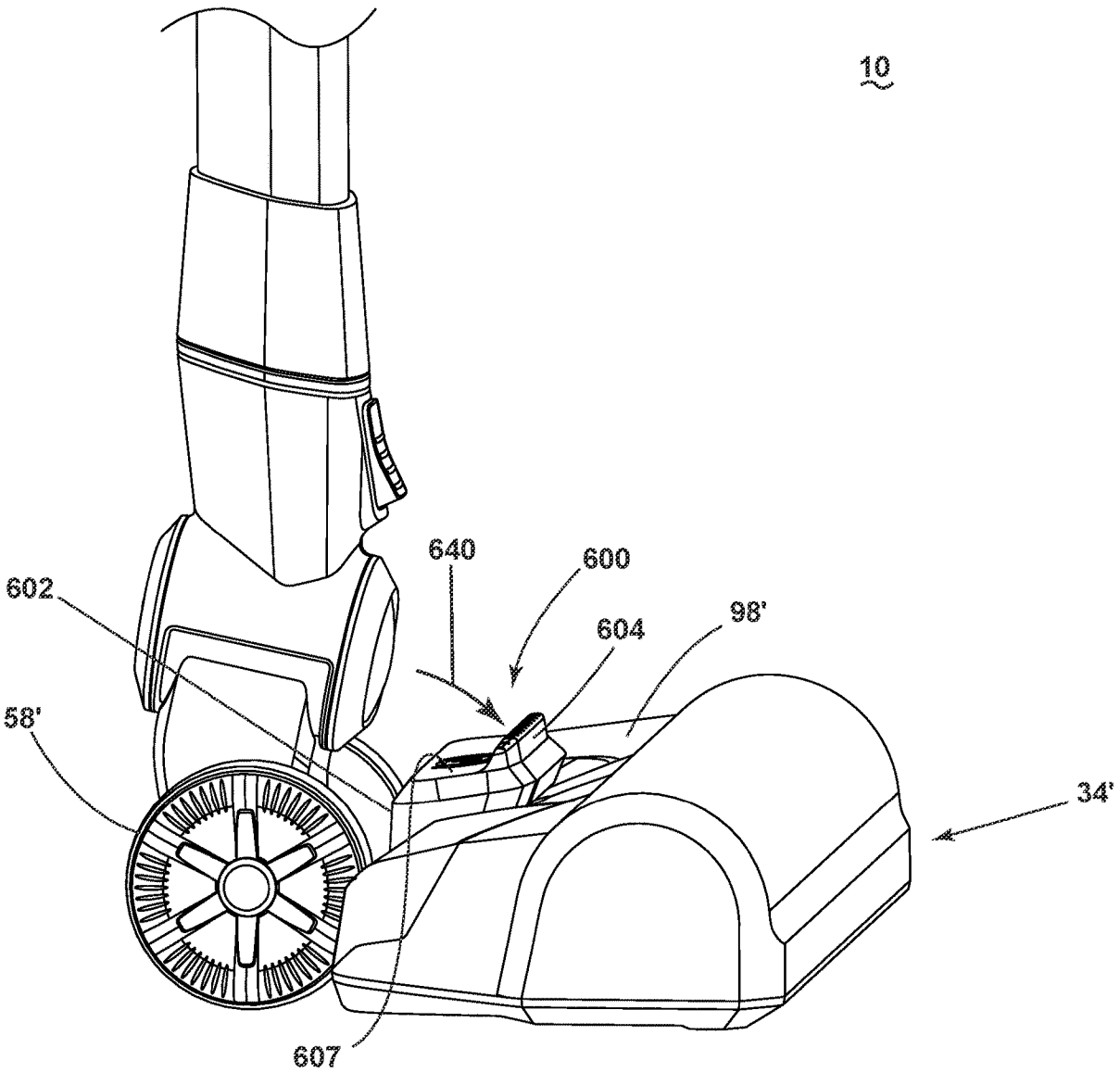
FIG. 14 is a perspective view of another exemplary base assembly that can be utilized in the vacuum cleaner of FIG. 2 and further including yet another exemplary brake assembly shown in a first locked position.

Referring now to FIG. 14, the brake assembly 600 provided with the base assembly 34', and more specifically rotatably or pivotally mounted to the base assembly 34', can include a body 602 with at least a portion of the body 602 extending into the base assembly 34' and another portion extending beyond the upper surface 98' of the base assembly 34'. The body 602 can further include an upper portion, handle, or protrusion 604 that can be similar to the corresponding portions of any of the previously described brake assemblies 100, 200, 300, 400, 500. The protrusion 604 can extend beyond the upper surface 98' of the base assembly 34' such that the protrusion 604 is accessible to a user. The protrusion 604 of the brake assembly 600 can further include a stepping surface 607 at least partially defined by the protrusion 604. The stepping surface 607 can be positioned on the brake assembly 600 such that, when a user steps on or otherwise applies downward pressure, such as in the direction shown by an arrow 640, to the stepping surface 607, the brake assembly 600 is moved into the first or locked position, as shown, wherein at least a portion of the brake assembly 600 contacts at least one of the wheels 58', as shown in FIG. 15.

Figure 15:
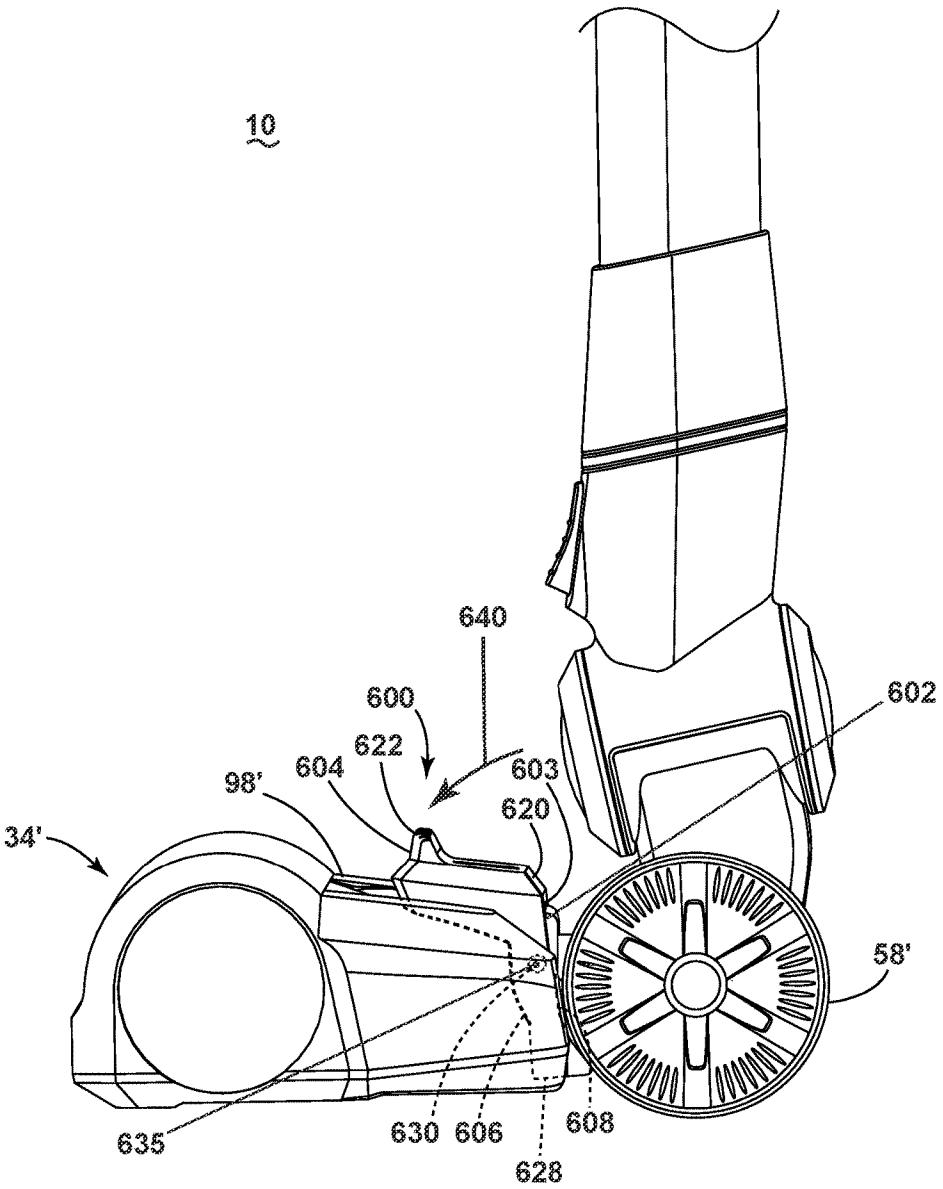
FIG. 15 is a side view of the base assembly of FIG. 14, with the brake assembly shown partly in phantom and in the first locked position.

In FIG. 15, the engagement of the body 602 of the brake assembly 600 with at least one of the wheels 58' in the first, locked position is more clearly shown. The portion of the body 602 located within an interior of the base assembly 34' is shown in phantom. As can be more clearly seen, the body 602 can further include at least one lower portion or at least one leg 606. The at least one leg 606 can extend at least partially into the base assembly 34' adjacent the at least one of the wheels 58', such that the at least one leg 606 confronts, contacts, or is adjacent to the at least one of the wheels 58'. The at least one leg 606 can include a foot 628 defining a distal end of the at least one leg 606, opposite the protrusion 604. While only one leg 606 can be seen in the illustrated brake assembly 600, it will be understood that the at least one leg 606 can comprise first and second legs 606, such that the body 602 of the brake assembly 600 defines or includes the two legs 606 spaced apart from one another with the protrusion 604 extending between and joining the two legs 606, as described previously with respect to the brake assemblies 100, 200, 300, 400, 500.

The at least one leg 606 can further include a groove 608 provided on a first side 603 of the body 602. The groove 608 can define a depression formed within the body 602 of the brake assembly 600, and specifically within the at least one leg 606.

The protrusion 604 can further include a first portion 620 directly coupled to the at least one leg 606 and a second portion 622 defining a distal end of the brake assembly 600 spaced from the at least one leg 606, the second portion 622 defining an uppermost portion of the protrusion 604. The second portion 622 can be thought of as a grip portion 622 of the protrusion 604 such that the user can easily grasp or nudge with a foot the protrusion 604 of the brake assembly 600.

While the brake assembly 100 includes the passageway or through hole 130 that extends through a portion of the foot 128, the brake assembly 600 can instead include a passageway or aperture 630 extending through a portion of the leg 606 from one end or side to the other and at a position above the foot 628. A pin (not shown) or other member can be located in the aperture 630 and be received within a corresponding locator or detent in the housing of the base assembly 34'. Alternatively, a pin or protrusion may be unitarily formed with the body 602 and extend therefrom and no aperture may be necessary. The pin or protrusion, regardless of how it is formed, can at least partially define a pivot axis 635 for the brake assembly 600.

The brake assembly 600 can include any of the locks 112-512 as previously described with respect to the brake assemblies 100, 200, 300, 400, 500 and configured to maintain the brake assembly 600 in the first, locked position, as illustrated. Additionally, or alternatively, the brake assembly 600 can engage with the base assembly 34' via a snap fit or an interference fit to retain the brake assembly 600 in the first, locked position, as shown. More specifically, at least a portion of the protrusion 604 of the brake assembly 600 can engage in the snap fit or interference fit with the upper surface 98' of the base assembly 34' to retain the brake assembly 600 in the first, locked position, as shown. Regardless of what manner of lock is provided with the brake assembly 600, it will be understood that such locking mechanism can be automatically engaged when a user steps on or applies downward pressure to the protrusion 604, as in the direction of the arrow 640, such as to the stepping surface 607. When the brake assembly 600 is thus retained in the first, locking position, the brake assembly 600, such as specifically the foot 628 and/or the groove 608 of the at least one leg 606 confronts or otherwise is in direct contact with the at least one of the wheels 58', thus restricting rotational movement of the wheels 58'.

Figure 16:
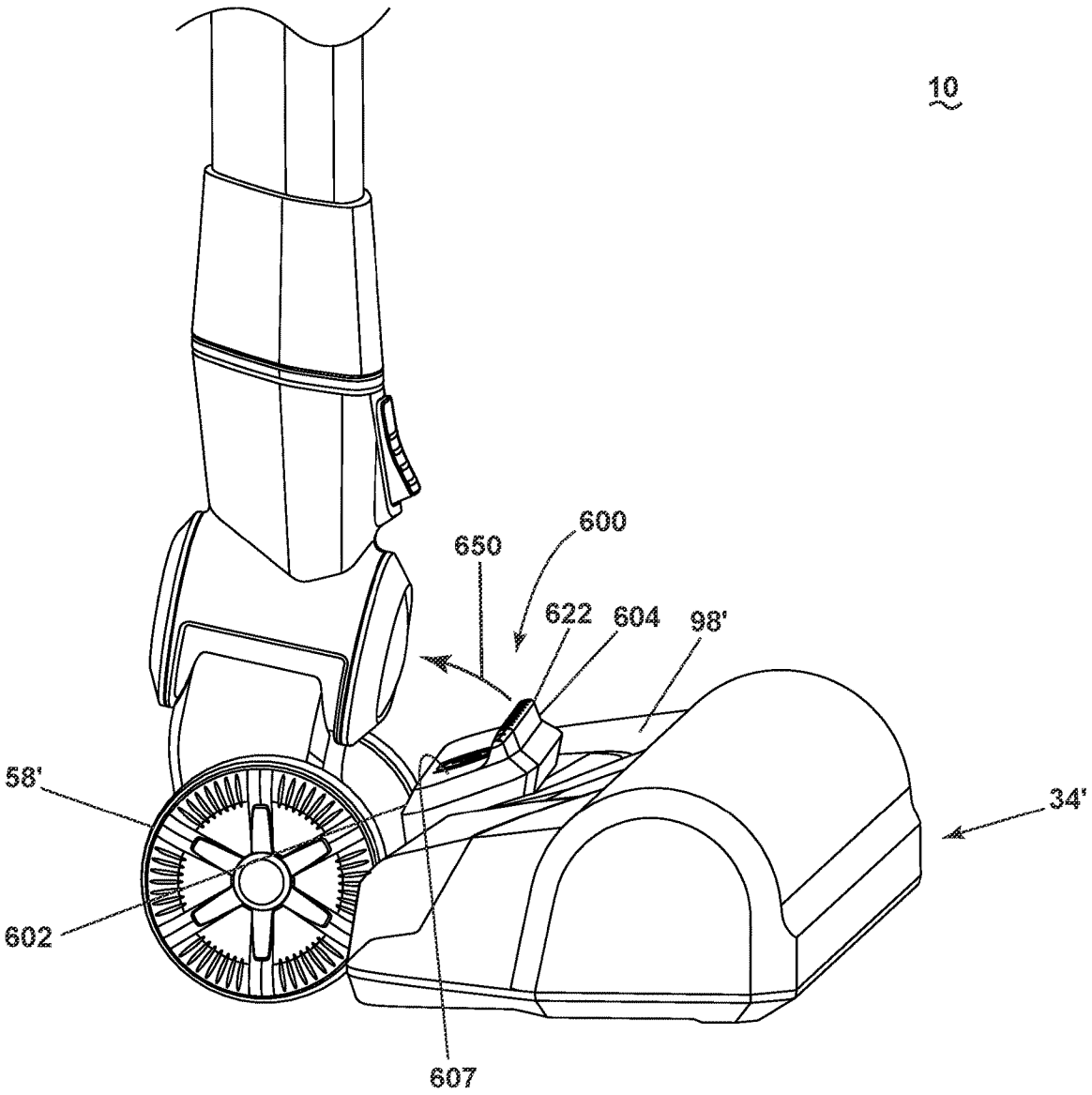
FIG. 16 is a perspective view of the base assembly of FIG. 14, with the brake assembly in a second unlocked position.

Turning now to FIG. 16, the brake assembly 600 is shown in the second, or unlocked, position. In the second, unlocked position, the brake assembly 600, and specifically the protrusion 604, is displaced from or moved at least partially away from the upper surface 98' of the base assembly 34', such as in the direction of an arrow 650. In one non-limiting example, at least a portion of the protrusion 604, such as at least the second portion 622, can be shifted upwardly and rearwardly away from the upper surface 98' of the base assembly 34' in the direction of the arrow 650 as the brake assembly 600 pivots about the pivot axis 635 in the direction of the arrow 650.

Figure 17:
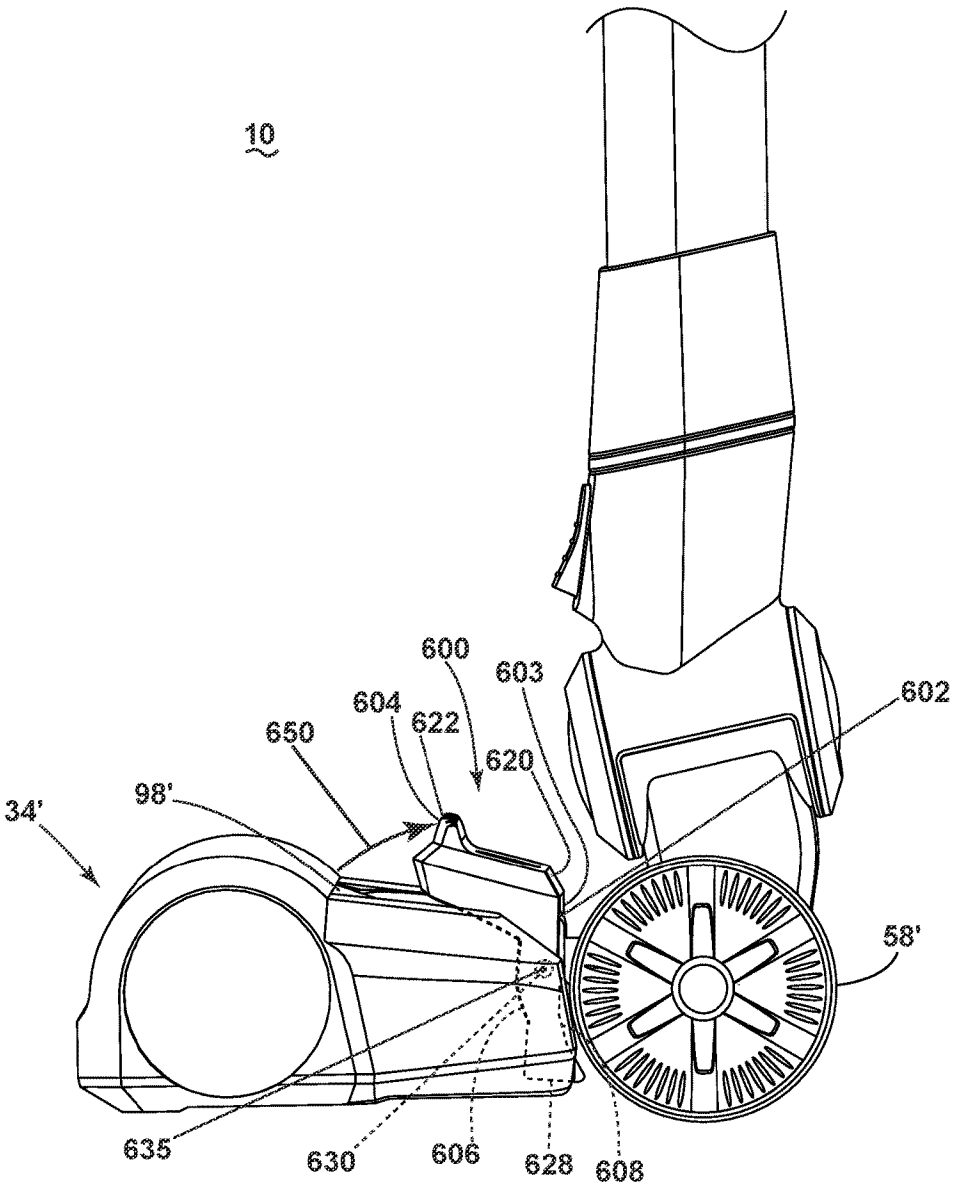
FIG. 17 is a side view of the base assembly of FIG. 15, with the brake assembly shown partly in phantom and in the second unlocked position.

Further, and as can be better seen in FIG. 17, in the second, unlocked position, the groove 608 of the at least one leg 606 is no longer in contact with the at least one of the wheels 58'. In the case that the protrusion 604 engages in a snap fit or interference fit with the base assembly 34', the protrusion 604 is removed from the snap fit or interference fit with the base assembly 34' in the second position. Additionally, or alternatively, in the case that the brake assembly 600 includes any of the previously described locks 112-512, the lock 112-512 is removed from engagement with the base assembly 34' in the second position. As such, the at least one of the wheels 58' are not engaged by a portion of the brake assembly 600, and thus the wheels 58' are free to rotate.

In operation, the brake assembly 600 can transition between the first position and the second position to selectively engage the at least one of the wheels 58'. When the brake assembly 600 is moved from the second or unlocked position (FIGS. 16-17) to the first, locked position (FIGS. 14-15), in the direction of the arrow 640, the brake assembly 600, and more specifically the groove 608 and/or the foot 628, contacts the at least one of the wheels 58' to restrict rotational movement of the at least one of the wheels 58', as described previously with respect to the brake assembly 100. In the second position, the brake assembly 600 can be displaced from or otherwise be moved to not contact the at least one of the wheels 58', thus allowing for free rotational movement of the wheels 58'. As discussed herein, the brake assembly 600 can be selectively locked or unlocked via a foot or hand of a user.

To release the vacuum cleaner 10 from the locked position (FIGS. 14-15), the brake assembly 600 is moved from the first, locked position (FIGS. 14-15) to the second, unlocked position (FIGS. 16-17) by a user applying upward or rearward pressure to the protrusion 604, in the direction of the arrow 650, such as by gripping the protrusion 604 or by nudging the protrusion 604 with a foot, which moves the brake assembly 600 out of contact with the at least one of the wheels 58' to allow rotation of the at least one of the wheels 58'.

With respect to the brake assembly 600, it may be more intuitive to move the vacuum cleaner 10 into the locked position (FIGS. 14-15), as the brake assembly 600 is moved from the second, unlocked position (FIGS. 16-17) to the first, locked position (FIGS. 14-15), by a user applying a downward pressure on the protrusion 604, in the direction of the arrow 640, such as by pressing on or stepping on the stepping surface 607.

The variety of brake assembly features described in the present disclosure can be provided in any suitable combination to improve user experience with the vacuum cleaner, and in particular when providing at least a portion of the vacuum cleaner in a storage position, such as when the vacuum cleaner is not in use or when the hand-held portion of the vacuum cleaner is in use and the base assembly and the wand are left in the storage position. The brake assemblies can all serve to ensure that the vacuum cleaner maintains its storage position and to reduce the risk of the vacuum cleaner falling over or sliding away from the storage position. Furthermore, these features provide for the vacuum cleaner to be able to achieve a stable, steady storage position in a variety of environments, such as leaning against a wall or being provided in a self-supporting, stand-alone storage position. Any of the variety of the brake assemblies disclosed herein can be used independently, or in combination with features of at least one other brake assembly, to provide a vacuum cleaner that is versatile and adaptable to a user's needs.

To the extent not already described, the different features and structures of the various aspects of the present disclosure may be used in combination with each other as desired. Thus, the various features of the different aspects may be mixed and matched as desired to form new aspects, whether or not the new aspects are expressly described.

While aspects of the present disclosure have been specifically described in connection with certain specific aspects thereof, it is to be understood that this is by way of illustration and not of limitation. Reasonable variation and modification are possible within the scope of the forgoing disclosure and drawings without departing from the spirit of the present disclosure which is defined in the appended claims. Hence, specific dimensions and other physical characteristics relating to the aspects disclosed herein are not to be considered as limiting, unless the claims expressly state otherwise.

What is claimed is:

1. A surface cleaning apparatus, comprising:

a base assembly comprising:

a housing having an uppermost surface, the housing at least partially defining a suction nozzle; and at least one wheel;

a hand-held portion having a hand grip, a recovery container, and a suction source in fluid communication with the suction nozzle and the recovery container and configured for generating a working airstream;

a wand operably coupled between the base assembly and the hand-held portion and defining at least a portion of a working air path extending from the suction nozzle to an air outlet in the hand-held portion and including the suction source; and a brake assembly pivotally mounted to the base assembly and moveable between a first locked position wherein at least a first portion of the brake assembly contacts the at least one wheel and is configured to prevent rotation of the at least one wheel and a second unlocked position wherein a second portion of the brake assembly extends above the uppermost surface of the housing, and wherein when the second portion is depressed the brake assembly is pivoted from the second unlocked position to the first locked position via pivoting the brake assembly downwardly relative to the housing of the base assembly.

2. The surface cleaning apparatus of claim 1 wherein the brake assembly is moveable into the second unlocked position via pivoting the brake assembly upwardly away from the base assembly.

3. The surface cleaning apparatus of claim 1 wherein the brake assembly comprises a pin unitarily formed with a body of the brake assembly and at least partially defining a pivot axis for the brake assembly.

4. The surface cleaning apparatus of claim 1 wherein the brake assembly defines an aperture extending through at least a third portion of a body of the brake assembly.

5. The surface cleaning apparatus of claim 4 wherein the brake assembly further comprises a pin located in the aperture and at least partially defining a pivot axis for the brake assembly.

6. The surface cleaning apparatus of claim 1 wherein the second portion of the brake assembly comprises a stepping surface.

7. The surface cleaning apparatus of claim 6 wherein the brake assembly is configured such that a user stepping on the stepping surface moves the brake assembly into the first locked position.

8. The surface cleaning apparatus of claim 1 wherein the brake assembly comprises a body having a first leg and a second leg, defining two legs spaced apart from one another and a protrusion joining the first leg and the second leg and extending therebetween, wherein the second portion includes the protrusion.

9. The surface cleaning apparatus of claim 8 wherein at least a portion of the first leg contacts the at least one wheel when the brake assembly is in the first locked position.

10. The surface cleaning apparatus of claim 9 wherein the first leg includes a groove and the groove contacts the at least one wheel.

11. The surface cleaning apparatus of claim 8 wherein the protrusion includes a first protrusion portion and a second protrusion portion, the second protrusion portion defining a distal end of the brake assembly and extending beyond the housing of the base assembly.

12. The surface cleaning apparatus of claim 11 wherein the brake assembly is moved into the first locked position when downward pressure is applied to the distal end.

13. The surface cleaning apparatus of claim 12 wherein the distal end engages in a snap fit with the housing of the base assembly when the brake assembly is in the first locked position.

14. The surface cleaning apparatus of claim 11 wherein the brake assembly is moved into the second unlocked position when upward pressure is applied to the distal end.

15. The surface cleaning apparatus of claim 8 wherein the brake assembly is moved into the first locked position when downward pressure is applied to the protrusion.

16. The surface cleaning apparatus of claim 15 wherein the protrusion engages in a snap fit with the base assembly when the brake assembly is in the first locked position.

17. The surface cleaning apparatus of claim 8 wherein the brake assembly is moved into the second unlocked position when upward pressure is applied to the protrusion.

18. The surface cleaning apparatus of claim 1 wherein the at least one wheel includes multiple wheels and the brake assembly contacts a first wheel of the multiple wheels.

19. The surface cleaning apparatus of claim 18 wherein the contacting the first wheel restricts the multiple wheels from rotating.

* * * * *